US005428343A

United States Patent [19]

Kikuchi et al.

[11] Patent Number: 5,428,343

[45] Date of Patent: Jun. 27, 1995

[54] DISASTER PREVENTION MONITORING APPARATUS AND METHOD

[75] Inventors: Masamichi Kikuchi; Yoshinori Kojima; Munemasa Suzuki, all of Tokyo, Japan

[73] Assignee: Hochiki Corporation, Tokyo, Japan

[21] Appl. No.: 213,750

[22] Filed: Mar. 16, 1994

[30] Foreign Application Priority Data

Mar. 17, 1993 [JP] Japan ..... 5-056987

[51] Int. Cl.[6] ..... G08B 26/00

[52] U.S. Cl. ..... 340/518; 340/505; 340/825.06; 340/825.08; 340/514

[58] Field of Search ..... 340/518, 505, 506, 514, 340/825.06–825.13

[56] References Cited

U.S. PATENT DOCUMENTS 5,173,683 12/1992 Brighenti et al. ..... 340/505

FOREIGN PATENT DOCUMENTS 0298132 1/1989 European Pat. Off. .
0485878 5/1992 European Pat. Off. .
61-247918 11/1986 Japan ..... G01D 3/02
62-217399 9/1987 Japan ..... G08B 17/00
464713 10/1992 Japan ..... A62C 2/24
2114344 8/1983 United Kingdom .
2175392 11/1986 United Kingdom .
2224144 4/1990 United Kingdom .
2254984 10/1992 United Kingdom .
8904032 5/1989 WIPO .

*Primary Examiner*—Donnie L. Crosland
*Attorney, Agent, or Firm*—Sughrue, Mion, Zinn, Macpeak & Seas

[57] ABSTRACT

A terminal of a disaster prevention monitor of the present invention detects the power-on of a terminal and sets flag information. When a polling call from a central monitor (receiver) is directed to a terminal after a power-on operation, the terminal transmits an information fetch request signal which requests the receiver enter an initialization routine for initialization of the terminal information. The receiver transmits an information request command signal to the terminal. The terminal transmits information to the receiver identifying the type of terminal which is responding. Depending on the type of terminal, the receiver may command test operations at the terminal and obtain the test results therefrom in order to generate and store proper initialization information about the terminal.

20 Claims, 16 Drawing Sheets

SENSOR REPEATER
14
24-1
24-2
26
68
R1
R2
70
ZD3
ON-OFF SENSOR
74
R3
R4
78
76
TERMINATOR
TERMINATOR
72
ZD2
R0
64-1
64-2
64-n
FIRE-DISCON. CIRCUIT
TEST CIRCUIT
66-1
66-2
66-n
35V
62
BOOSTER
80
CONTOUR VOLTAGE MONITOR CIRCUIT
20V
60
58
+3.2V
CONSTANT-VOLTAGE CIRCUIT
ZD1
ZD2
D1
D2
42
48
A/D CONVERTER
CONTROL CIRCUIT
44
CPU
46
MEMORY
50
TRANSMIT-RECEIVE CIRCUIT
52
54
ADDRESS SET CIRCUIT
56
AA
V
S
SC
ACKNOWLEDGEMENT REPLY LINE
SENSOR LINE
SIGNAL LINE
COMMON

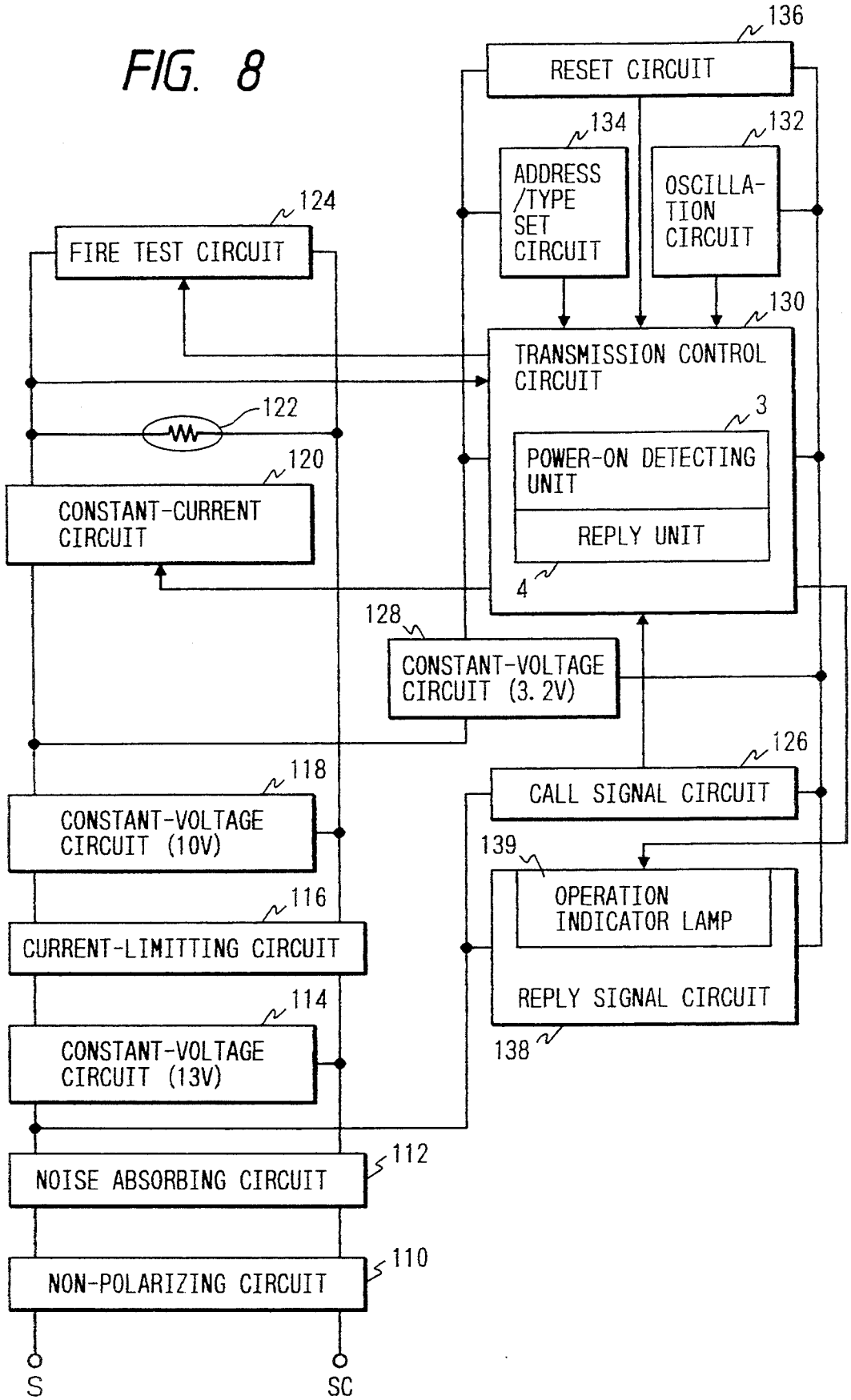
FIG. 8
136
RESET CIRCUIT
134
ADDRESS /TYPE SET CIRCUIT
132
OSCILLA-TION CIRCUIT
124
FIRE TEST CIRCUIT
130
TRANSMISSION CONTROL CIRCUIT
3
POWER-ON DETECTING UNIT
REPLY UNIT
4
122
120
CONSTANT-CURRENT CIRCUIT
128
CONSTANT-VOLTAGE CIRCUIT (3. 2V)
126
CALL SIGNAL CIRCUIT
118
CONSTANT-VOLTAGE CIRCUIT (10V)
139
OPERATION INDICATOR LAMP
116
CURRENT-LIMITTING CIRCUIT
REPLY SIGNAL CIRCUIT
114
CONSTANT-VOLTAGE CIRCUIT (13V)
138
112
NOISE ABSORBING CIRCUIT
110
NON-POLARIZING CIRCUIT
S
SC CONTROL LOAD
CONTROL LOAD
CONTROL LOAD
DDn, DAn, DCn
DD1
DA1
DC1
LOAD CONNECTION CIRCUIT
ACKNOWLEDGEMENT DETECTION CIRCUIT
PC2
VOLTAGE MONITOR CIRCUIT
PC6
PC1
SMOOTHING CIRCUIT
RELAY DRIVING CIRCUIT
CONTROL CIRCUIT
PC1
PC2
PC3
PC4
PC5
PC6
ADDRESS SET CIRCUIT
DELAY TIME SET CIRCUIT
CONSTANT -VOLTAGE CIRCUIT
TRANSMIT -RECEIVE CIRCUIT
DD
DDC
S
SC
D10
D20
D30
ZD10
20
30
30
30
30
140
142
144
146
148
150
152
154
156-1
156-2
156-3
156-4
160
162
164-1
164-4
166-1
168-1
170
172
a
b
215
214

DISASTER PREVENTION MONITORING APPARATUS AND METHOD

BACKGROUND OF THE INVENTION

1. Field of the Invention

The present invention relates to a disaster prevention monitoring apparatus and method which collects terminal information in response to a call from a receiver end to collectively monitor an abnormal status such as a fire.

2. Description of the Related Art

An example of a conventional disaster prevention monitor is disclosed in Examined Japanese Patent Publication No. HEI. 4-64713. In the disclosed disaster prevention monitor, when an abnormal status at a terminal, such as when a terminal fails to reply to a call from a receiver, is detected, the receiver commands the terminal to transmit information as to the type of the terminal (hereinafter referred to as "type information").

Specifically, an occasion may occur in which one sensor is replaced by another sensor of a different type after the disaster prevention monitor is powered on. When the old sensor is removed and no reply is made to a call from the receiver, the receiver commands the terminal to transmit type information, whereby type information is obtained from the new sensor and transmitted to the receiver (also referred to as a central station). In accordance with the type information, the receiver again initializes information relating to the sensor and stored in the receiver.

In such a conventional disaster prevention monitor, however, a plurality of sensors are sequentially called in accordance with a polling sequence controlled at the receiver. Where the number of sensors is very large, the polling period will be very long, and it is possible that a sensor can be replaced by a new sensor within the time between successive pollings of the sensor. In such a case, the receiver will not know that the sensor has been replaced and, as a result, will not enter a mode to initialize to the new sensor.

SUMMARY OF THE INVENTION

It is an object of the present invention to provide a disaster prevention monitor and apparatus in which the replacement of one terminal with another during the period between polling of the terminal by the receiver will not go unrecognized by the receiver, and the receiver can properly conduct initialization of information for the new sensor.

FIG. 1 is a block diagram illustrating the principle of the present invention.

The invention is directed to a disaster prevention monitor in which a plurality of terminals 2 are connected to receiving unit or central station 1 through a transmission line, and each of the terminals 2 receives a call signal from the receiving unit 1 and replies to the call signal by transmitting terminal information.

In the disaster prevention monitor of the invention, each of the terminals 2 comprises: a power-on detecting unit 3 for detecting if the power of the terminal is turned on and for setting a flag when it is turned on; a reply unit 4, responsive to a call from the receiving unit 1 after a power-on operation, for transmitting an information fetch request signal requesting the receiving unit 1 to fetch information necessary for initialization of the terminal information, on the basis of the state of the flag information of the power-on detecting unit 3; and at least one detector for detecting a disaster such as a fire or the like.

The receiving unit 1 comprises a terminal information initializing unit 5, which is responsive to receipt by the receiving unit of an information fetch request signal from one of the terminals 2, for transmitting an information request command signal to the terminal 2 and for conducting initialization of information of the terminal which has been powered on.

The terminal information initializing unit 5 transmits to at least the terminal 2 a type information request command signal and initializes the terminal information in accordance with the type information transmitted from the terminal 2.

For example, if the type information from a terminal indicates a sensor repeater to which an on-off fire sensor is connected through a signal line, a fire test command signal is further transmitted by the receiver so that the terminal conducts a test operation on the on-off fire sensor and test results are transmitted to the receiver.

If the type information from a terminal indicates an analog fire sensor, an analog value request command signal is transmitted by the receiver so that zero-point information is collected, and a fire test command signal is transmitted so that the terminal conducts a test operation. Test analog values, which indicate predetermined detected physical values obtained as a result of the terminal test, are collected. Information required for correction of analog values transmitted from the terminal is generated on the basis of the zero-point information and the test analog values.

If the type information from a terminal indicates an analog fire sensor which has an on-off fire sensor comparing a detected analog value with a threshold corresponding to a predetermined detection sensitivity to transmit a fire detection signal, an analog value request command signal is transmitted so that zero-point information is collected, and the terminal is caused to conduct a test operation. The test analog values, which indicate predetermined detected physical values obtained as a result of the terminal test, are collected. Information required for correction of analog values transmitted from the terminal is generated on the basis of the zero-point information and the test analog values. Furthermore, threshold information for providing a detection sensitivity, which is corrected on the basis of the correction information, is transmitted to the terminal and the sensitivity is set.

When a terminal is a sensor repeater or an analog fire sensor, the terminal information initializing unit 5 of the receiving unit 1 transmits to the terminal an interrupt inhibit command signal for inhibiting an interruption reply transmission of a fire signal, before the transmission of the test command signal, so that information obtained in the terminal test is transmitted as a reply signal in response to a cyclic call signal which designates the terminal address and which is sequentially transmitted from the receiving unit.

In contrast, if the type information indicates a control repeater to which a control load is connected through a signal line, it is only necessary to conduct an initialization process for setting the terminal information to be transmitted from the terminal.

The receiving unit or central station 1 may consist only of a receiver of the type disclosed, or it may consist of a receiver and one or more repeater panels, each of which functions as a local receiver connected to a transmission line extending from the receiver, or it may consist of only repeater panels which function as local receivers connected to each other through a transmission line.

According to the disaster prevention monitor of the invention, even when a terminal is replaced with another one within the period between callings of the terminal which are repeated at the polling period, a fetch of information required for initialization of terminal information is requested in response to a call from the receiver upon the detection of the power-on state of the new terminal. Consequently, terminal information can be initialized after the replacement of the terminal, and the disaster monitoring can adequately be conducted in accordance with the type of the new terminal.

When the receiving unit recognizes a replaced terminal as a repeater for an on-off fire sensor, a test command is issued to conduct a test operation for automatically confirming whether or not the new terminal properly functions so as to assure the reliability of the monitor.

When an analog sensor is recognized from the terminal information sent to the receiver, an analog value request command signal and a test command are issued so as to collect zero-point information and test analog values. Based upon the collected information, information for correcting detection properties of the new analog sensor is generated to initialize the replacement sensor, thereby enabling the monitoring operation to be properly conducted in the manner conforming to the properties of the new sensor.

Further, for an analog sensor having the function of an on-off sensor which transmits a fire signal in accordance with the predetermined sensitivity setting, the threshold of the detection sensitivity of the new sensor is corrected on the basis of test results of the sensor to set the corrected threshold of the sensor.

BRIEF DESCRIPTION OF THE DRAWINGS

FIG. 8 is a block diagram showing an embodiment of an analog heat sensor shown in FIG. 2;

PREFERRED EMBODIMENT OF THE INVENTION

A preferred embodiment of the present invention will be described with reference to the accompanying drawings.

Figure 2:
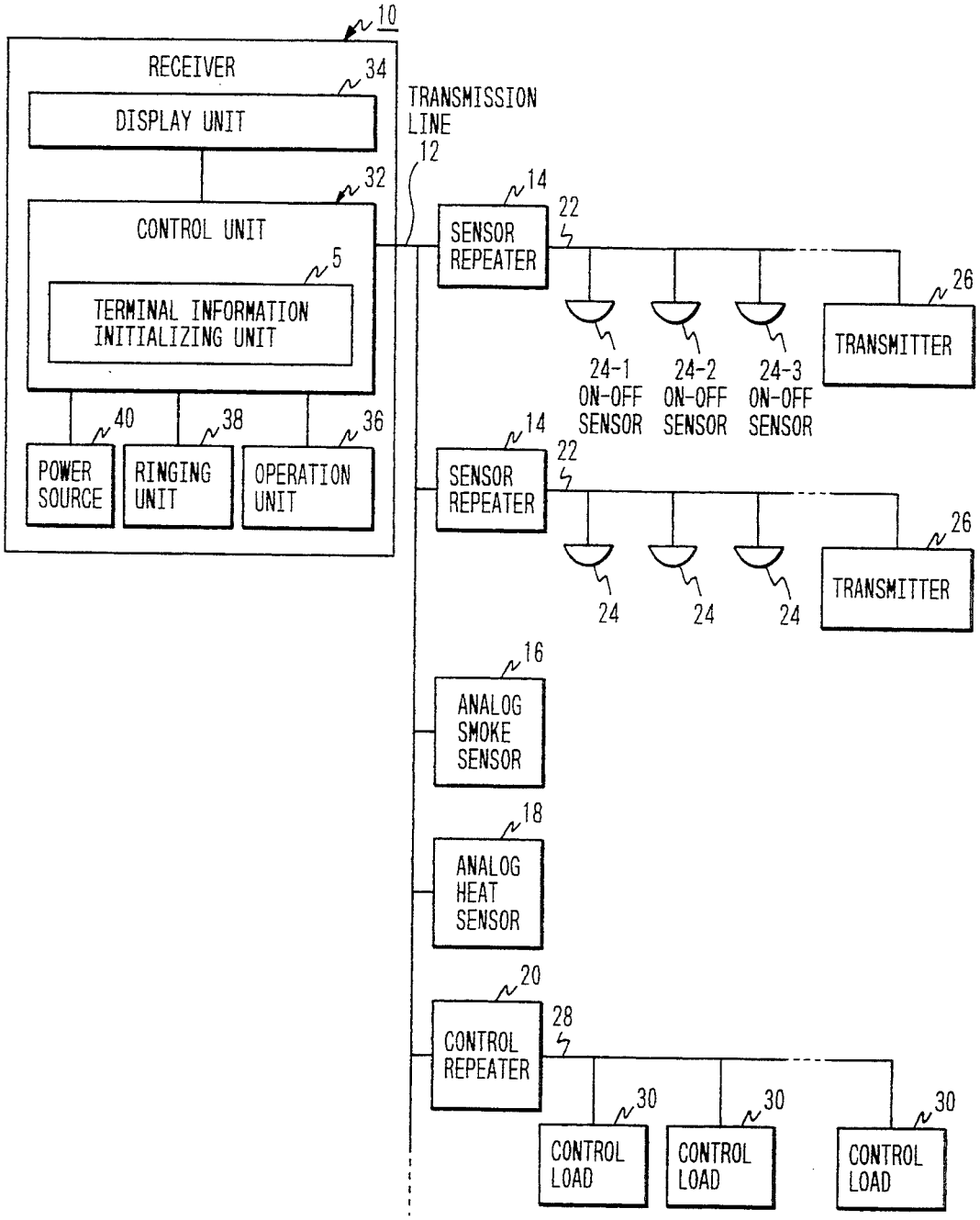
FIG. 2 is a block diagram of a preferred embodiment of invention.

FIG. 2 illustrates an entire configuration of the invention. In FIG. 2, reference numeral 10 designates a receiver. Sensor repeaters 14, an analog smoke sensor 16, an analog heat sensor 18, and a control repeater 20 are connected as terminals to a transmission line 12 extending from the receiver 10. A sensor line 22 extends from each of the sensor repeaters 14. On-off sensors 24-1, 24-2, 24-3, . . . , and a transmitter 26, which transmits a fire signal in response to a switch operation, are connected to each sensor line 22.

The receiver 10 comprises a control unit 32 which includes a central processing unit (CPU). A display unit 34, an operation unit 36, a ringing unit 38 for producing an alarm or outputting a voice message, and a power source 40 are connected to the control unit 32. The control unit 32 calls or polls a terminal by designating the address of the terminal and conducts the polling operation to collect information from the terminal. During the polling, at an interval of, for example, 1 sec., the control unit 32 issues a sampling command for information batch collection which instructs in block all of the terminals to collect information. In response to the sampling command, detected data is collected and held at substantially the same time in all of the terminals. After the information batch collection, detected terminal information which is held in each terminal is transmitted to the receiver 10 through the usual polling process.

In the embodiment of FIG. 2, terminals of different types, i.e., the sensor repeaters 14, the analog smoke sensor 16, the analog heat sensor 18, and the control repeater 20, are connected to the transmission line 12. These terminals perform the same functions as a repeater relative to the information batch collection command and the handling of calls from the receiver 10. As seen from the receiver 10, therefore, these terminals are respectively assigned a series of terminal addresses, for example, 127 addresses (address 1 to address 127).

Figure 1:
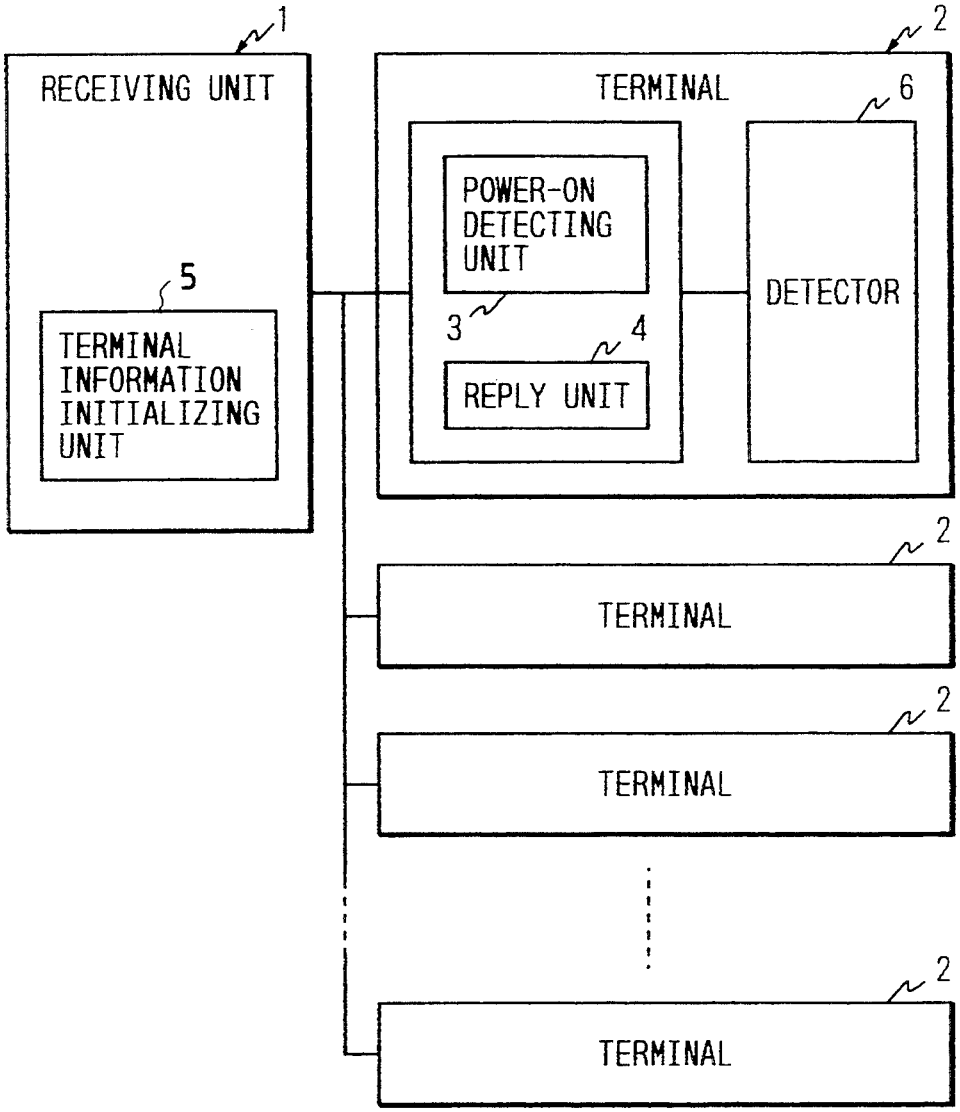
FIG. 1 is a block diagram illustrating the principle of the invention.

Each of the sensor repeaters 14, the analog smoke sensor 16, the analog heat sensor 18, and the control repeater 20 which are connected as terminals to the receiver 10 is provided with the functions of a power-on detecting unit 3 and a reply unit 4, shown in FIG. 1. The control unit 32 of the receiver 10 is provided with the function of a terminal information initializing unit 5 shown in FIG. 1.

The power-on detecting unit provided in each terminal detects the power-on condition of the terminal when it receives power through the transmission line 12 as a result of a power-on operation of the receiver 10. The power-on detecting unit sets flag information indicating the power-on status of the terminal. Also when a terminal connected to the transmission line 12 is replaced with another terminal and the replacement terminal is connected to the transmission line, the power-on detecting unit of the new terminal detects the power-on condition and sets the flag information indicative of the power-on status.

In addition, the reply unit provided in each terminal checks the existence of the setting state of the flag information when it is polled by the receiver 10. If the setting state exists, the reply unit determines that the current call or poll is the first one to be made following the power-on initiation, and transmits to the receiver 10 an information fetch request data which requests the fetch of information necessary for initialization of the terminal information.

When the terminal information initializing unit 5 of the control unit 32 receives an information fetch signal from a terminal, the terminal information initializing unit 5 transmits an information request command, which commands the terminal to send transmitting information necessary to initialize the terminal information. In response, the terminal which was powered on transmits at least type information.

With respect to the control repeater 20, reply information which is to be transmitted in response to the information request command from the terminal information initializing unit 5 of the receiver 10 includes only type information. However, with respect to the sensor repeater 14, the reply information further includes information of test operations of the on-off sensors 24. In addition, with respect to the analog smoke sensor 16 and the analog heat sensor 18, the test analog value based on zero-point information and test analog values are transmitted, and information required for correcting detection properties of the new analog sensor is generated in the terminal information initializing unit 5 of the receiver 10.

That is, the receiver 10 receives information relating to the various terminals and processes them. Specifically, the processes are that initialization the information received from the terminals, especially the on-off sensor 24 in which the information is not stored in the receiver 10, and storing the analog information(signal) received from the terminals, especially each the analog sensors 16 and 18.

The receiver 10 stores the analog signal so as to be able to get hold of high analog level time zone in 24 hours (when the analog level is high in a day). Accordingly, in the high analog level time zone, the receiver 10 raises a disaster determination level, and in contrary, in a low analog level time zone, the receiver lowers the level so as to detect a fire disaster earlier. Namely, in the noon, the smoke of cigarettes, dust and the like make the analog level of the analog smoke sensor 16 be higher, and in contrary, the analog level is lower in the night. Therefore, the disaster prevention apparatus can monitor the disaster condition in accordance with such a situation.

The prospect of the fire disaster condition can be performed by storing the analog signal. As disclosed in Unexamined Japanese Patent Publication Sho. 62-217399, when an analog signal from an analog sensor tend to arise, a prospect operation is carried out so as to output a prealam before the analog signal is over the predetermined level of the fire disaster.

Figure 3:
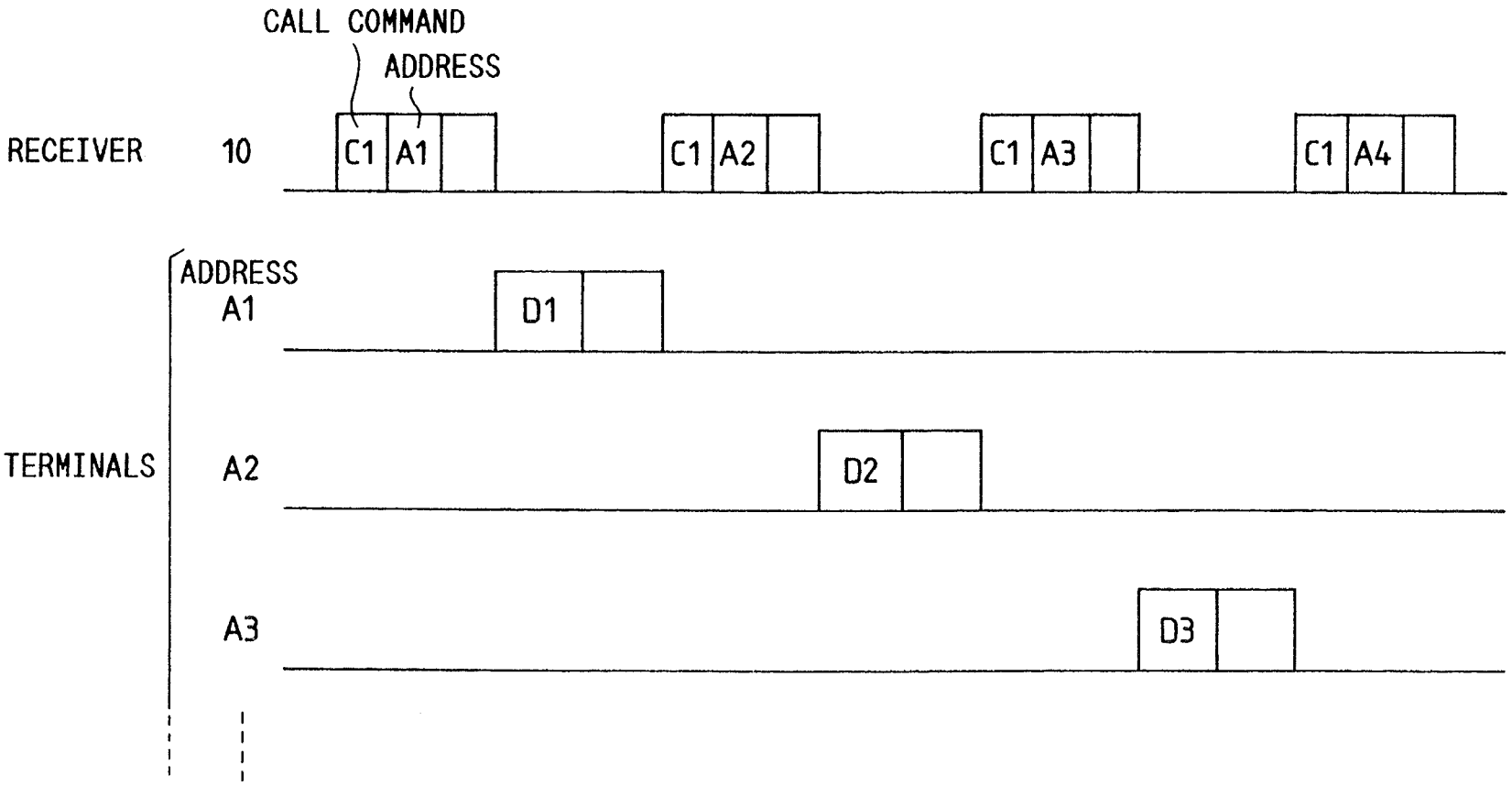
FIG. 3 is a timing chart showing the polling of terminals according to the invention.
Figure 4:
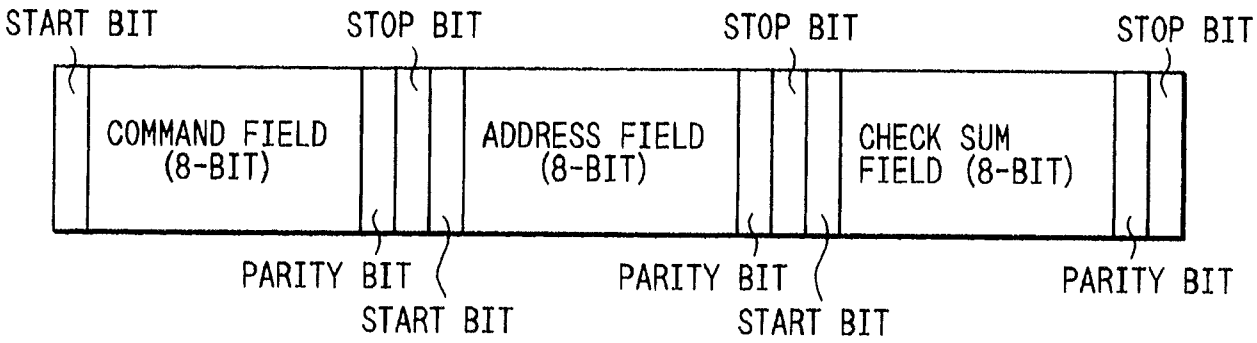
FIG. 4 illustrates the transmission format of a call signal from a receiver.

FIG. 3 is a timing chart showing usual calling operations conducted between the receiver 10 and the terminals of FIG. 1. In FIG. 3, the receiver 10 transmits in sequence call signals, each of which includes a call command C1 and one of the terminal addresses A1, A2, A3, . . . . As shown in FIG. 4, each call signal consists of 3 bytes of an 8-bit command field, an 8-bit address field, and an 8-bit checksum field.

A start bit is disposed before each byte, and a parity bit and a stop bit are disposed after each byte, respectively. The command data in the command field informs the terminals of operation to carry out in response thereto. In the present invention, in order to initialize terminal information in the receiver 10, the command field is used to transmit the information fetch request command, the analog value request command, the fire test command, and the like.

Figure 5:
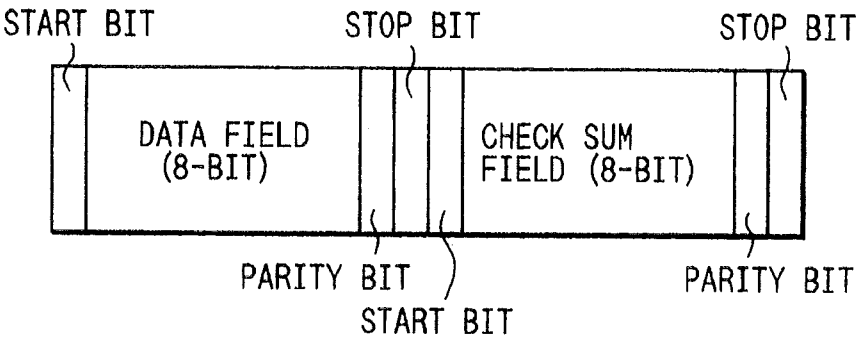
FIG. 5 illustrates the transmission format of a reply signal from a terminal.

FIG. 5 shows the transmission format of a reply signal from a terminal. A reply signal comprises 2 bytes of an 8-bit data field and an 8-bit checksum field. A start bit is disposed before each byte, and a parity bit and a stop bit are disposed after each byte.

Figure 6:
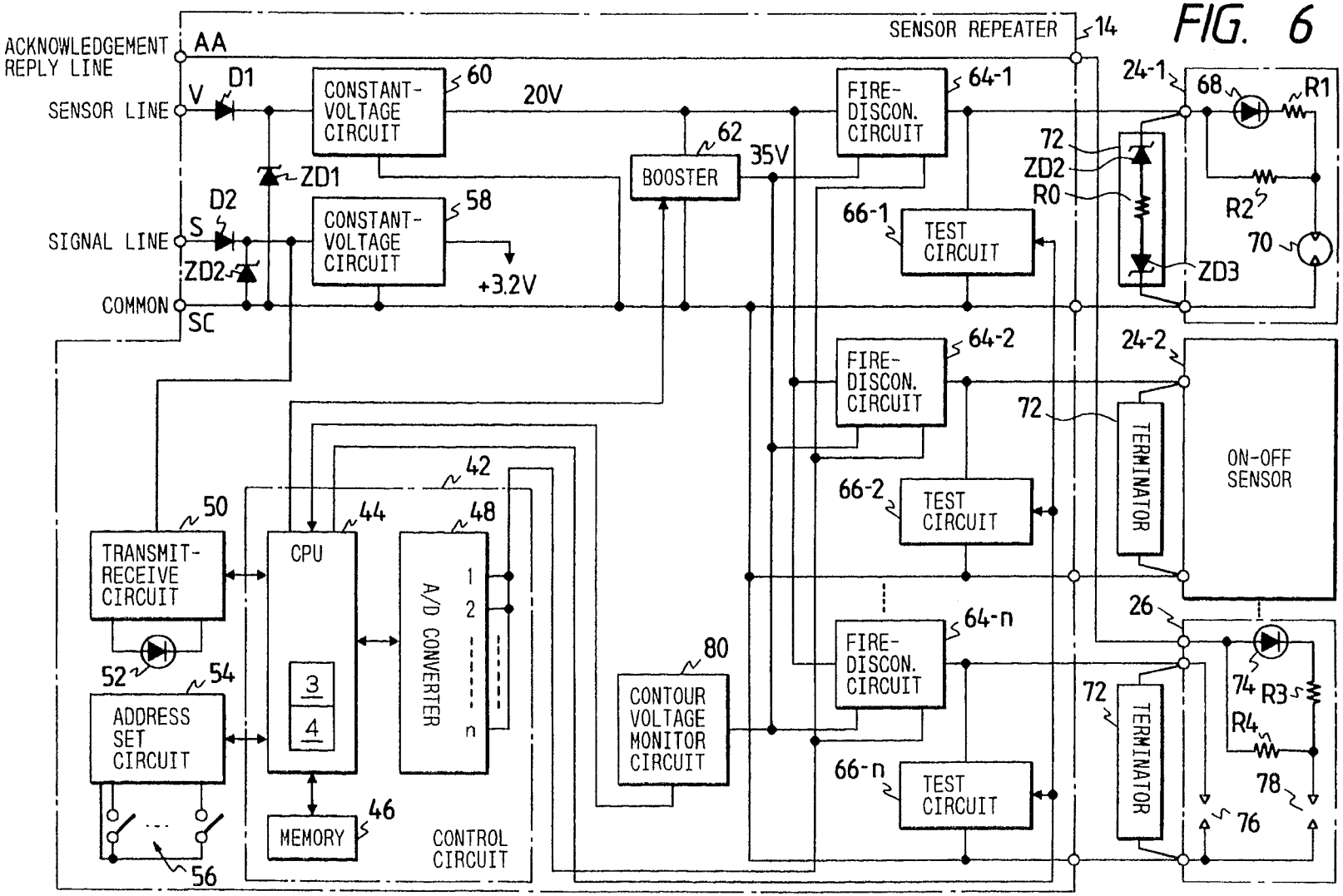
FIG. 6 is a block diagram showing an embodiment of a sensor repeater shown in FIG. 2.

FIG. 6 is a block diagram showing the circuit of an embodiment of the sensor repeater 14 which is used for the on-off sensors 24 in FIG. 2. In FIG. 6, the sensor repeater 14 is provided with a control circuit 42 which has a CPU 44 functioning as a control unit, a memory 46 which may be a RAM or the like, and an A/D converter 48. The CPU 44 is connected to a transmit-receive circuit 50 and an address set circuit 54. The transmit-receive circuit 50 receives call signals from the receiver 10 and supplies the call signals in a voltage mode to the CPU 44, and receives reply signals from the CPU 44 and transmits the reply signals to the receiver 10 in a current mode. The transmit-receive circuit 50 includes an indicator lamp 52 which blinks in accordance with data bits of 1 and 0 of the transmitted and received signals.

The address set circuit 54 sets predetermined terminal addresses therein and provides the terminal addresses to the CPU 44. The addresses are set through an address setting switch using dip switches or the like. The CPU 44 functions as the power-on detecting unit 3 and the reply unit 4 shown in the principle diagram of FIG. 1. Further, the A/D converter 48 of the control circuit 42 has input ports which are indicated by numbers 1 to n and to which external devices such as on-off sensors and transmitters can be connected. The maximum number of external devices which can be connected to the A/D converter 48 equals the number of the input ports. In the embodiment shown, the on-off sensors 24-1 to 24-(n-1) and the transmitter 26 are connected to ports 1 through n, respectively, of the A/D converter 48.

In the transmission line side for the receiver, the sensor repeater 14 is provided with a signal line terminal S, a sensor line terminal V, an acknowledgment reply line terminal AA, and a common terminal SC, so that the sensor repeater 14 is connected to the receiver 10 by four lines. A diode D2 and a zener diode ZD2 are connected to the signal line terminal S and the common terminal SC, respectively, and a constant-voltage circuit 58 is disposed in the next stage.

The constant-voltage circuit 58 supplies a DC voltage of, for example, 3.2 V to the control circuit 42. A diode D1 and a zener diode ZD1 are connected to the sensor line terminal V, and a constant-voltage circuit 60 is disposed in the next stage. The constant-voltage circuit 60 outputs a power source voltage of, for example, 20 V required for the on-off sensors 24-1 to 24-(n-1) and the transmitter 26. The output of constant-voltage circuit 60 is supplied to fire-disconnection detectors 64-1 to 64-n and test circuits 66-1 to 66-n, which correspond respectively to the on-off sensors 24-1 to 24-(n-1) and the transmitter 26.

A booster 62 supplies a boosted voltage of 35 volts DC to the fire-disconnection detectors 64-1 to 64-n. When the CPU 44 receives the sampling command for an information batch collection, the booster 62 is temporarily operated so as to apply the boosted voltage of 35 V, which is higher than the usual power source voltage of 20 V, as the detection operation voltage to the detection circuits.

As shown in the box of the on-off sensor 24-1, for example, in each of the on-off sensors 24-1 to 24-(n-1), a resistor R2 is connected in parallel With a series circuit of a signal indicator lamp 68 and a resistor R1, and a sensor contact 70 is connected to the parallel circuit. A terminator 72 is connected across the terminals of the on-off sensor 24-1. The terminator 72 comprises a series circuit of a zener diode ZD2, a resistor R0, and a zener diode ZD3. The zener diodes ZD2 and ZD3 are inversely directed so that, even when the terminator is reversely connected to the sensor, either of the zener diodes can operate.

During the period when the data sampling is not to be conducted, the usual power source voltage of 20 V is applied to the zener diodes ZD2 and ZD3. One of the diodes will be reverse biased, but not enough to cause conduction, so no current will flow in the terminator 72. During the data sampling period, the DC voltage of 35 V from the booster 62 is applied to the zener diodes ZD2 and ZD3. This voltage is sufficient to render the reverse biased diode conductive and current flows through the terminator 72. The transmitter 26 comprises a switch contact 76 which is closed by operating a push button, and another switch contact 78 which is closed with the closing operation of the switch contact 76. The switch contact 76 is connected to a sensor line from the fire-disconnection detector 64-n.

A signal line from the acknowledgment reply line terminal AA of the sensor repeater 14 enters the transmitter to be connected to the switch contact 78 through an acknowledgment lamp 74, and resistors R3 and R4. When the receiver 10 receives a fire detection signal from the transmitter 26, a voltage is supplied as an acknowledgment signal to the transmitter, and the acknowledgment lamp 74 is lit.

The test circuits 66-1 to 66-n of the sensor repeater 14 sequentially operate when the sensor repeater 14 receives the test command from the receiver 10, so that the respective pairs of sensor lines are short-circuited. This produces a false fire detection state which is identical with the case where any of the sensor contacts 70 and the switch contact 76 of the transmitter operates. Under the false fire detection state, the test is conducted. Also in the test operation period, the booster 62 is operated so as to supply the boosted voltage of 35 V DC. It is a matter of course that a test method other than that described above may be adopted. For example, test units for testing the operation of the detection unit may be disposed in each of the on-off sensors 24.

Sampling data which is fetched by the A/D converter 48 of the control circuit 42 has a voltage range of 0 to 30 V. The voltage range is divided into three regions, which are arranged from the lowest voltage in the sequence to represent a fire detection region, a normal detection region, and a disconnection detection region. The CPU 44 detects the fire, normal, and disconnection states, depending on the voltage level of the sampling data from the A/D converter 48.

When the CPU 44 detects a fire in a data sampling which is conducted on the reception of the terminal information batch collection command from the receiver 10, the CPU 44 immediately conducts an interrupt reply for transmitting the fire detection signal, without awaiting a call from the receiver 10. Also when a fire test is done by using one of the test circuits 66-1 to 66-n, the interrupt reply of the fire detection is conducted. In a fire test, therefore, the receiver 10 first transmits an interrupt inhibit command for inhibiting the interrupt reply.

When the CPU 44 at a terminal (repeater or analog sensor) decodes the interrupt inhibit command, the data obtained in the fire test is held in the memory 46, and the test data is sent in response to a call from the receiver 10 addressed to the terminal. The inhibition of the interrupt reply is canceled upon the reception of an interruption inhibit cancellation command from the receiver 10.

Figure 7:
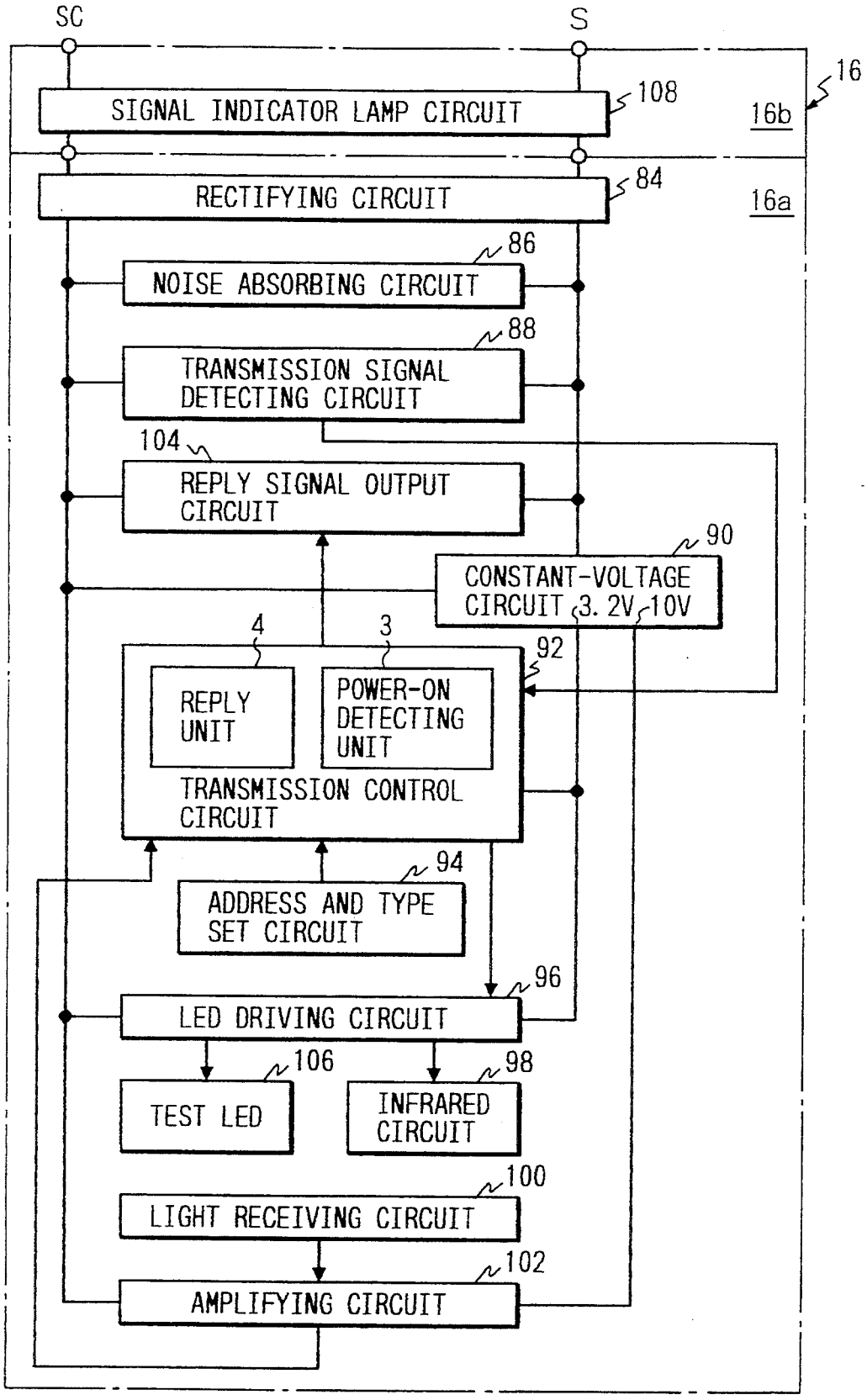
FIG. 7 is a block diagram showing an embodiment of an analog smoke sensor shown in FIG. 2.

FIG. 7 is a block diagram showing an embodiment of the analog smoke sensor 16 shown in FIG. 2. In FIG. 7, the analog smoke sensor comprises a sensor body **16*a* and a sensor base 16*b*. The sensor body 16*a* comprises a rectifying circuit 84 for depolarizing the connection polarity of the base, a noise absorbing circuit 86, and a transmission signal detecting circuit 88 which detects the call signal transmitted from the receiver 10 in a voltage mode and supplies it to a transmission control circuit 92**.

Address information and type information from an address and type set circuit 94 are provided to the transmission control circuit 92. Namely, the transmission control circuit 92 has the same function as that of the control circuit 42 of the sensor repeater 14 shown in FIG. 6. In other words, the transmission control circuit 92 comprises power-on detecting unit 3 for detecting the power-on of the repeater and for setting flag information indicative of the power-on state, and reply unit 4, which responds when the flag information of the power-on detecting unit 3 is in the set state and a call is received from the receiver 10, by transmitting an information fetch request signal which requests the receiver 10 to fetch information necessary for initialization of the terminal information.

Smoke detection is performed by the combination of an LED driving circuit 96, an infrared LED 98, a light receiving circuit 100, and an amplifying circuit 102. The transmission control circuit 92 further comprises a test LED 106 for the test operation. When the transmission control circuit 92 receives the sampling command from the receiver 10, it drives the infrared LED 98 to emit light, conducts an A/D conversion to convert a smoke detection signal obtained from the light receiving circuit 100 and the amplifying circuit 102 into digital detection data, and stores the detected data into a memory. The smoke detection structure using the infrared LED 98 and the light receiving circuit 100 is usually of the scattered light type.

Further, when the transmission control circuit 92 receives a test command from the receiver 10, it drives the test LED 106 to emit light, and conducts an A/D conversion to convert a smoke detection signal obtained from the light receiving circuit 100 and the amplifying circuit 102 into test data, so as to store the test data into the memory. The test LED 106 opposes a light receiving element of the light receiving circuit 100 so as to directly irradiate the element with light of intensity corresponding to a predetermined smoke density.

The reply signal from the transmission control circuit 92 is supplied to a reply signal output circuit 104 so that it is transmitted to the receiver 10 in a current mode. The components following the transmission control circuit 92 operate under the supply of a constant voltage from a constant-voltage circuit 90. The sensor base **16*b* further comprises a signal indicator lamp circuit 108** which drives the signal indicator lamp exposed to the outside when a fire is detected, to emit light.

When the transmission control circuit 92 judges that a fire exists based on detection data which is collected in response to a sampling command from the receiver 10, a fire reply signal is transmitted to the receiver 10 by interruption (i.e., an interrupt routine takes over and is immediately carried out). The interruption reply is conducted in the same manner also in the case of the test using the test LED 106. The interruption reply signal can be prevented from being transmitted during the test period, by previously supplying an interrupt inhibit command from the receiver 10.

FIG. 8 is a block diagram showing an embodiment of the analog heat sensor 18 shown in FIG. 2. In FIG. 8, the analog heat sensor is connected to the signal lines from the receiver 10 at the signal line terminal S and the common terminal SC. The units connected to the terminals are a non-polarizing circuit 110, a noise absorbing circuit 112, a constant-voltage circuit 114 for generating a constant voltage output of, for example, 13 V, a current-limiting circuit 116, and another constant-voltage circuit 118 for generating a constant voltage output of, for example, 10 V.

Further, following a constant-current circuit 120, a heat detecting element 122, realized by a thermistor or the like, is connected. The constant-current circuit 120 receives a sampling control signal from a CPU which will be described later, to apply a detection voltage to the heat detecting element 122 so that a voltage depending on the impedance of the heat detecting element 122 which varies in accordance with the ambient temperature is fetched as the detection voltage by a CPU 130.

A fire test circuit 124 is connected in parallel to the heat detecting element 122. The fire test circuit 124 receives the test signal from the CPU 130, and sets the load impedance of the constant-current circuit 120 to the value corresponding to a predetermined temperature of, for example, 100° C. During the test period, the thermistor constituting the heat detecting element 122 has an impedance corresponding to ordinary temperature, and at a test temperature of 100° C., the thermistor has a very low impedance. Therefore, the test impedance depends on the resistance of a test resistor connected in a fire test circuit 124, and is substantially free from the effect of the impedance of the heat detecting element 122.

During the fire test period, the test voltage obtained in the impedance at the test temperature of 100° C. is fetched by the transmission control circuit (CPU) 130, and then stored in a memory as test data. A call signal circuit 126 detects the call signal from the receiver 10 in a voltage mode, and supplies it to a transmission control circuit 130. To the transmission control circuit 130 there is connected an oscillation circuit 132, an address and type set circuit 134, and a reset circuit 136 for resetting a power-on operation.

The transmission control circuit 130 has the same function as that of the control circuit 42 of the sensor repeater 14 shown in FIG. 6. In other words, the transmission control circuit 130 comprises power-on detecting unit 3 for detecting the power-on of the sensor and for setting flag information indicative of the power-on state, and reply unit 4, which responds when the flag information of the power-on detecting unit 3 is in the set state and a call is received from the receiver 10, by transmitting an information fetch request signal which requests the receiver 10 to fetch information necessary for initialization of the terminal information.

When the transmission control circuit 130 receives the sampling command for the information batch collection, the transmission control circuit 130 causes the constant-current circuit 120 to operate, so that a constant current flows through the heat detecting element 122. At this time, the voltage across the heat detecting element 122 is subjected to an A/D conversion and then fetched to be stored in memory as the detection voltage. The detection data stored in the memory is transmitted in response to a subsequent call from the receiver 10.

If the transmission control circuit 130 receives the test command transmitted from the receiver 10, it drives the constant-current circuit 120 and the fire test circuit 124 simultaneously, to falsely produce an impedance state corresponding to the test temperature of 100° C. so that the test detection voltage is A/D-converted to be stored in the memory as test data. In addition, if the transmission control circuit 130 judges that a fire condition exists, based on the detection data obtained during data sampling, a fire signal is transmitted to the receiver 10 by an interruption reply.

Also in the case where the fire signal is to be transmitted during the test period, the interruption reply is conducted in the same manner. An interruption reply signal can be prevented from being transmitted during a test period by previously supplying an interrupt inhibit command from the receiver 10. The reply signal from the transmission control circuit 130 is supplied from a reply signal circuit 138 to the receiver 10 in a current mode. The reply signal circuit 138 comprises an operation indicator lamp 139 which blinks in accordance with data bits of 1 and 0.

Figure 9:
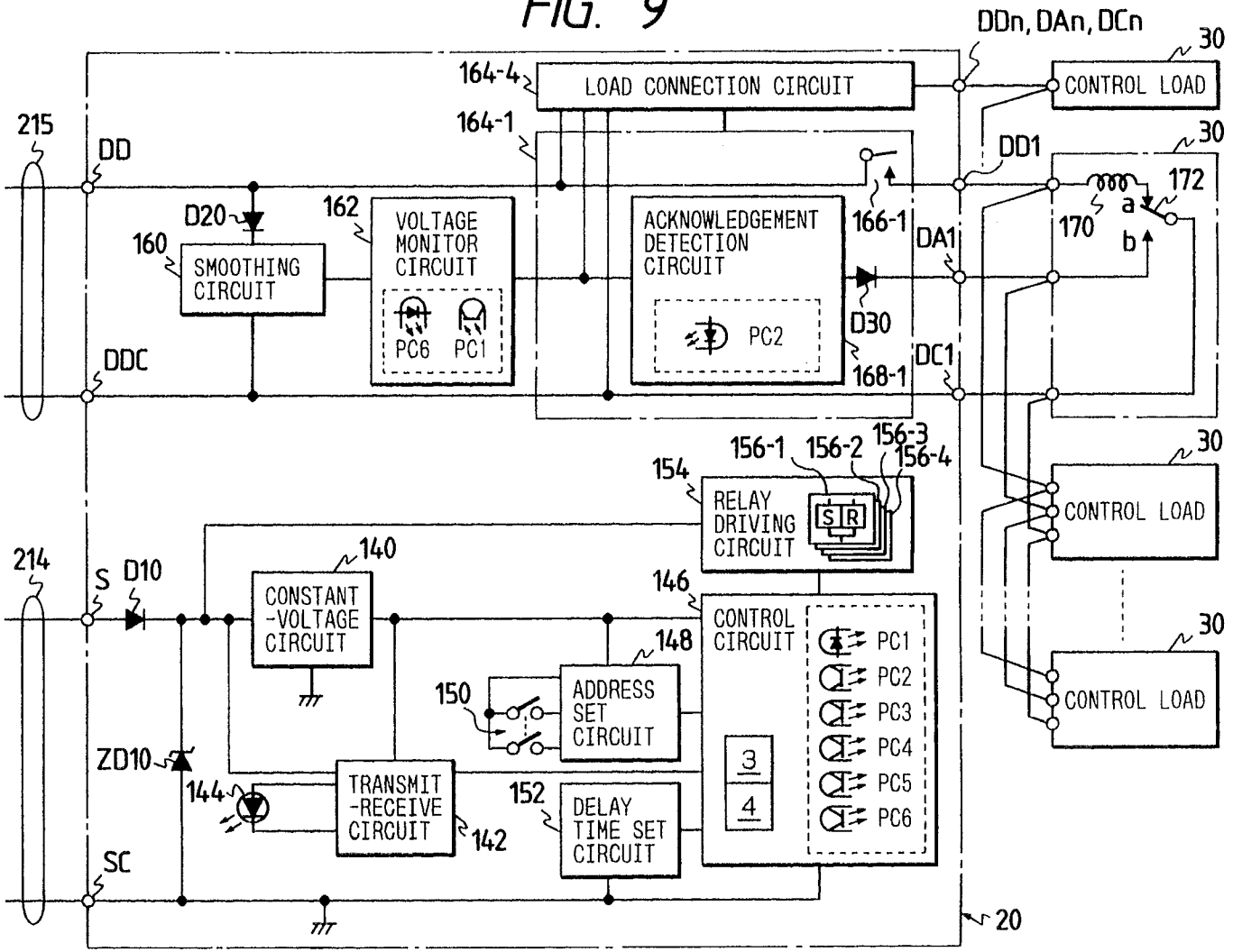
FIG. 9 is a block diagram showing an embodiment of a control repeater shown in FIG. 2.

FIG. 9 is a block diagram showing an embodiment of the control repeater 20 shown in FIG. 2. In FIG. 9, a pair of signal lines 214 are connected to the terminals S and SC of the control repeater 20. A diode D10 and a surge absorbing zener diode ZD10 are connected to the terminals S and SC. Furthermore, a constant-voltage circuit 140 for generating a voltage of 3.2 V DC required for operating a control IC and the like is provided.

A transmit-receive circuit 142 is disposed after the constant-voltage circuit 140. A transmission indicator lamp 144 which blinks under the transmit-receive state is connected to the transmit-receive circuit 142. The transmit-receive circuit 142 detects transmit data which is transmitted from the receiver 10 in a voltage mode, and outputs it to a control circuit 146. Furthermore, the transmit-receive circuit 142 transmits data from the control circuit 146 in a current mode.

An address set circuit 148 is connected to the control circuit 146, and sets a predetermined terminal address in accordance with the on-off state of an address setting switch 150. Furthermore, a relay driving circuit 154 is connected to the control circuit 146. In the embodiment, since four control loads can be connected, the relay driving circuit 154 is provided with four latching relays 156-1 to 156-4 so as to correspond to the maximum number of control loads.

Each of the latching relays 156-1 to 156-4 comprises a set coil S and a reset coil R. As shown with respect to the latching relay 156-1, for example, the relay contact of each latching relay is formed as a relay contact 166-1 which is disposed in a terminal DD side of power source lines 215 extending from the receiver 10.

In the latching relay 156-1, when the set coil S is energized, the relay contact 166-1 is closed, and the closed contact state is mechanically maintained even if the power supply to the relay coil is cut off. The reset coil R is energized to cancel the closed state of the relay contact 166-1. Accordingly, in each of the latching relays 156-1 to 156-4, a driving current has to be supplied to the set coil S or the reset coil R at each of the control and reset operations for the respective loads.

The power source lines 215 from the receiver 10 are connected to respective control loads 30 through connection circuits 164-1 to 164-4 connected to terminals DD and DDC. As representatively shown in the load connection circuit 164-1, each load connection circuit connects the respective load 30 to terminals DD1 and CD1 through the relay contact 166-1 of the latching relay of the relay driving circuit 154.

Furthermore, the load connection circuit has an acknowledgment detection circuit 168-1 from which a signal line for acknowledgment extends and is connected to the load 30 through a diode D30 and a terminal DA1. The other load connection circuits 164-2 to 164-4 have the same configuration as that of the load connection circuit 164-1. The acknowledgment detection circuits 168-1 to 168-4 of the load connection circuits 164-1 to 164-4 are commonly provided with a voltage monitor circuit 162 which monitors a power source voltage generated by a smoothing circuit 160 through a diode D20.

Hereinafter, the load 30 connected to the load connection circuit 164-1 will be described. In the embodiment, for example, the load 30 is a release for a fire door being provided with a solenoid coil 170 for driving the release. The load 30 is further provided with a damper switch 172, which connects to coil 170 at the side a during the closed state of the fire door and connects to diode D30 at the side b when the fire door is opened.

When the control circuit 146 energizes the set coil S of the latching relay 156-1 of the relay driving circuit 154 in response to a control command signal from the receiver 10, the relay contact 166-1 in the load connection circuit 164 is closed to energize the solenoid coil 170, for example so as to trip the release which holds the fire door at the open state. When the holding of the fire door is canceled, the connection state of the damper switch 172 is changed from the side a to the side b so that a signal current flows from the acknowledgment detection circuit 168-1 to the control load 30 through the diode D30.

The signal current through D30 causes a light emitting diode of a photocoupler PC2, disposed in the acknowledgment detection circuit 168-1, to emit light. A phototransistor of the photocoupler PC2 disposed in the control circuit 146 receives the emitted light, and the control circuit 146 transmits an acknowledgment detection signal to the receiver 10 through the transmit-receive circuit 142 by interruption.

The light emitting diodes corresponding to phototransistors of photocouplers PC3 to PC5 in the control circuit 146 are disposed in the acknowledgment detection circuits of the other load connection circuits 164-2 to 164-4, respectively.

When the control circuit 146 receives a voltage monitor command from the receiver 10, the voltage monitor circuit 162 is operated. In other words, on the reception of the voltage monitor command, the control circuit 146 drives the light emitting diode of a photocoupler PC1 to emit light, a phototransistor of the photocoupler PC1 disposed in the voltage monitor circuit 162 receives the emitted light, and the voltage monitor circuit 162 judges whether or not the power source voltage obtained from the smoothing circuit 160 is normal.

If the power source voltage is normal, the light emitting diode of the photocoupler PC6 disposed in the voltage monitor circuit 162 is driven to emit light, and the phototransistor of the photocoupler PC6 disposed in the control circuit 146 receives the emitted light. In this case, a data bit indicating a normal state of the power source voltage is set in the reply data field in response to the polling from the receiver 10. In contrast, when the power source voltage is not normal because of disconnection of the power source lines 215 or any reason, the phototransistor of the photocoupler PC6 fails to receive light, resulting in the control circuit 146 setting a data bit in the reply data field to indicate an abnormal state of the power source and transmits to the receiver 10 the data indicating an abnormal state of the power source as a reply to a call.

Alternatively, the voltage monitor circuit 162 may be operated when it receives a sampling command for information batch collection in place of a voltage monitor command.

The control circuit 146 (similar to the case of the control circuit in the sensor repeater 14 of FIG. 6) comprises power-on detecting unit 3 for detecting the power-on of the circuit and for setting flag information indicative of the power-on state, and reply unit 4, which responds when the flag information of the power-on detecting unit 3 is in the set state and there is a call from the receiver 10, by transmitting an information fetch request signal which requests the receiver 10 to fetch information necessary for initialization of the terminal information.

The connection of the control loads 30 to the control repeater 20 may be accomplished in various ways. For example, a plurality of the control loads 30 may be connected in parallel as shown with respect to the load connection circuit 164-1. Alternatively, a single control load 30 may be connected as shown with respect to the load connection circuit 164-4.

Figure 10:
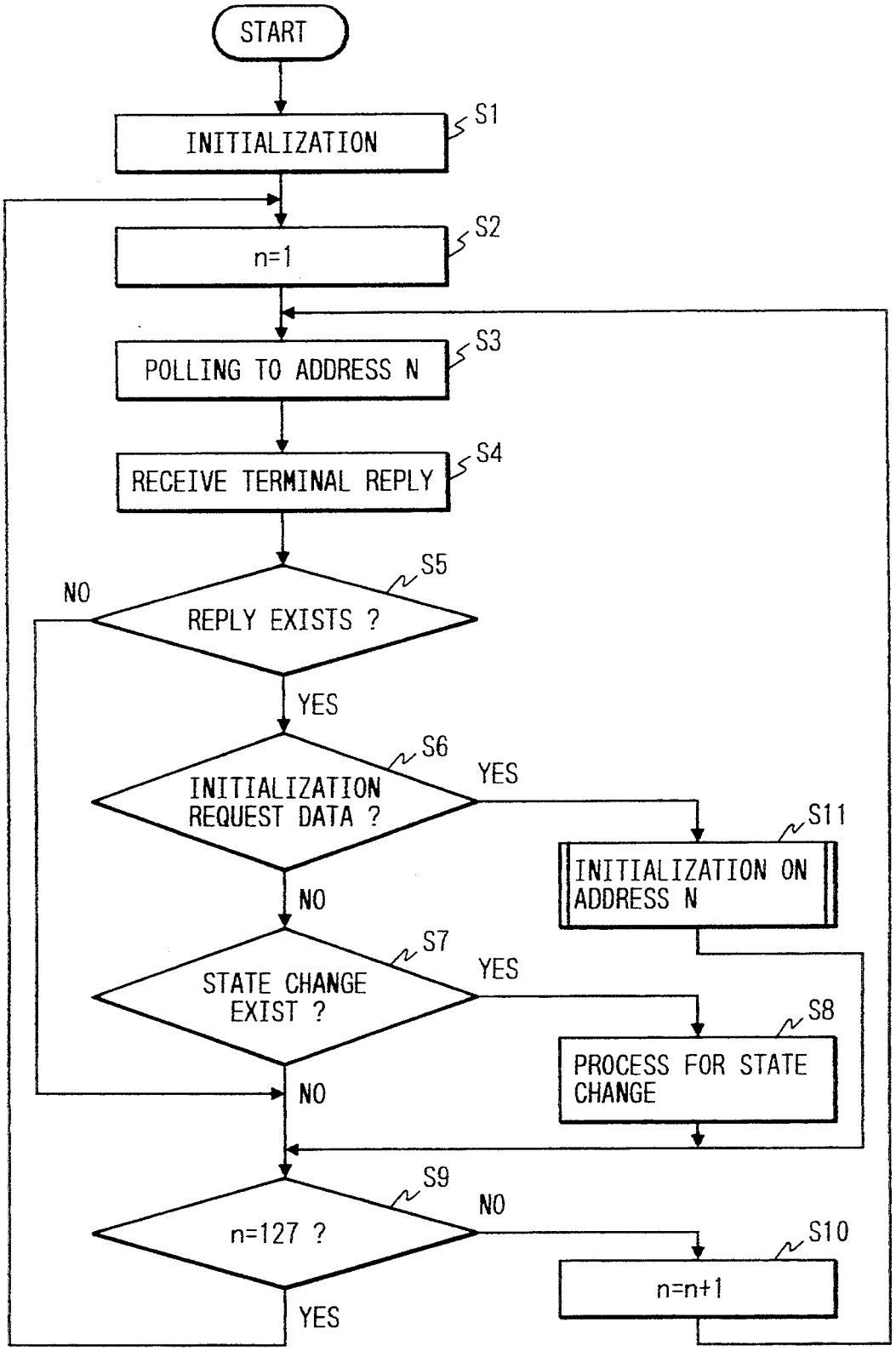
FIG. 10 is a flowchart showing the process of a receiver shown in FIG. 2.

FIG. 10 is a flowchart showing the process of the receiver 10 shown in FIG. 2. In FIG. 10, when the receiver 10 is powered on, a predetermined initialization process is conducted in step S1, and the terminal address n is set to 1 in step S2. Then, in step S3, terminal polling is conducted using the terminal address n. In step S4, a terminal reply to the polling is received. The existence of a terminal reply is checked in step S5. If a terminal reply exists, it is judged in step S6 whether or not the terminal reply is the initialization request data (the terminal information fetch request data). In the usual state of a terminal, the terminal will not transmit initialization request data because there will be no need for further initialization. In the latter condition, the process proceeds to step S7 to judge whether or not there is a state change in the terminal reply data. If there is a state change, the process proceeds to step S8 to execute a process for a state change.

The contents of the state change differ depending on the type of the terminal. With respect to the sensor repeater 14 to which the on-off sensors are connected, for example, a state change would include a fire detection, a fault detection, and the like. During the test period, the state change further includes test fire data as a test reply. With respect to the analog smoke sensor 16 or the analog heat sensor 18, terminal reply data to the polling are processed for each polling operation. Therefore, it is assumed that there is a state change in all reply data for the analog sensors, and a process for a state change in step S8 is executed. With respect to the control repeater 20, it is assumed that, when a fault such as disconnection of the power source lines occurs, there is a state change in the reply data, and a process for a state change in step S8 is executed.

If there is no state change in step S7, or when the process for a state change in step S8 is completed, the process proceeds to step S9 to judge whether or not the terminal address n reaches the final address, which is 127 in the embodiment. If the terminal address is not the final address, the terminal address is incremented by 1 in step S10, and the process returns to step S3 wherein the next terminal in the address sequence is polled. If the terminal address is the final address, the process returns to step S2 to repeat the terminal polling process from the initial address (n=1).

Whenever a terminal is replaced, whether this occurs immediately after the power-on operation of the receiver 10 or during the usual monitor state, the next time the terminal is polled, it will transmit an initialization request data as the terminal reply. In such case, therefore, the process at the receiver proceeds from step S6 to step S11 to execute the initialization process for the terminal of address n, from which the initialization request data is received. The initialization process will be described in detail later.

Figure 11:
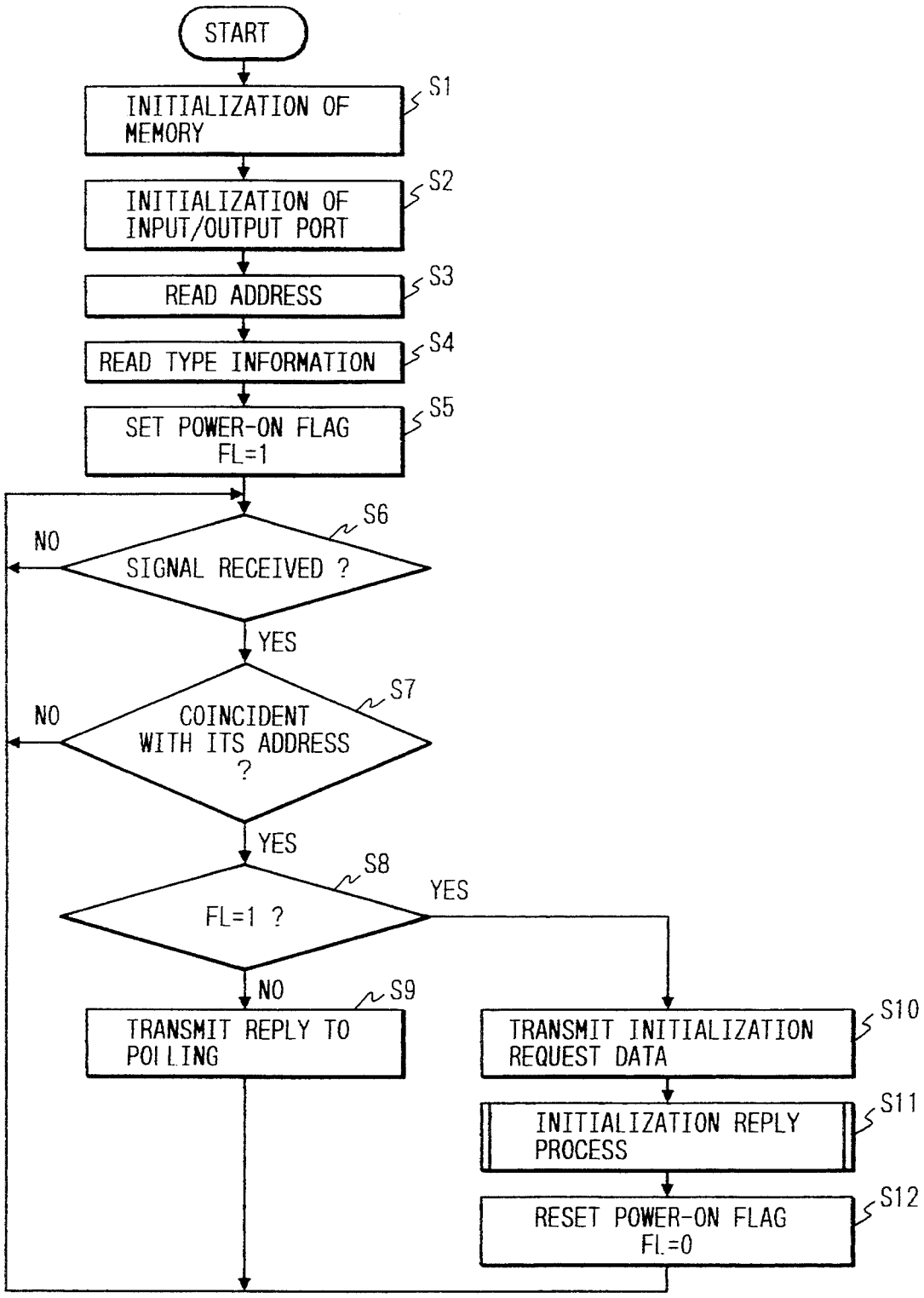
FIG. 11 is a flowchart showing the process of a repeater shown in FIG. 2.

FIG. 11 is a flowchart showing the process conducted in the terminals shown in FIG. 2. In FIG. 11, when the terminals are powered on, the initialization processes of steps S1 to S5 are first conducted. Namely, the memory is initialized in step S1, the input and output ports are initialized in step S2, a preset terminal address is read in step S3, the type information is read in step S4, and a power-on flag FL is set to 1 in step S5 by the function of the power-on detecting unit.

Then, in step S6, it is judged whether or not a polling signal from receiver 10 is received. If such a signal is received, it is judged whether or not the signal includes the address of the terminal. If the terminal address is in the polling signal, the power-on flag FL is checked in step S7. In the initial call which is conducted immediately after the power-on operation, the power-on flag FL is 1, and therefore the process proceeds to step S10 in which the initialization request data is transmitted to the receiver 10.

In response to the transmittance of the initialization request data from the terminal, the receiver 10 transmits various commands according to the initialization set process as shown in step S11 of FIG. 10. On the basis of these commands, therefore, initialization reply processes are executed in step S11. After a series of initialization reply processes is completed, the power-on flag FL is reset to 0, and the process returns to step S6.

For the polling from the receiver 10 in the usual monitor state, the power-on flag FL will be 0, and the process will proceed from step S8 to step S9, during which a reply transmission to the polling is conducted. The contents of the initialization reply processes in step S11 are peculiar to the type of the terminal for which initialization is being performed.

Figure 12:
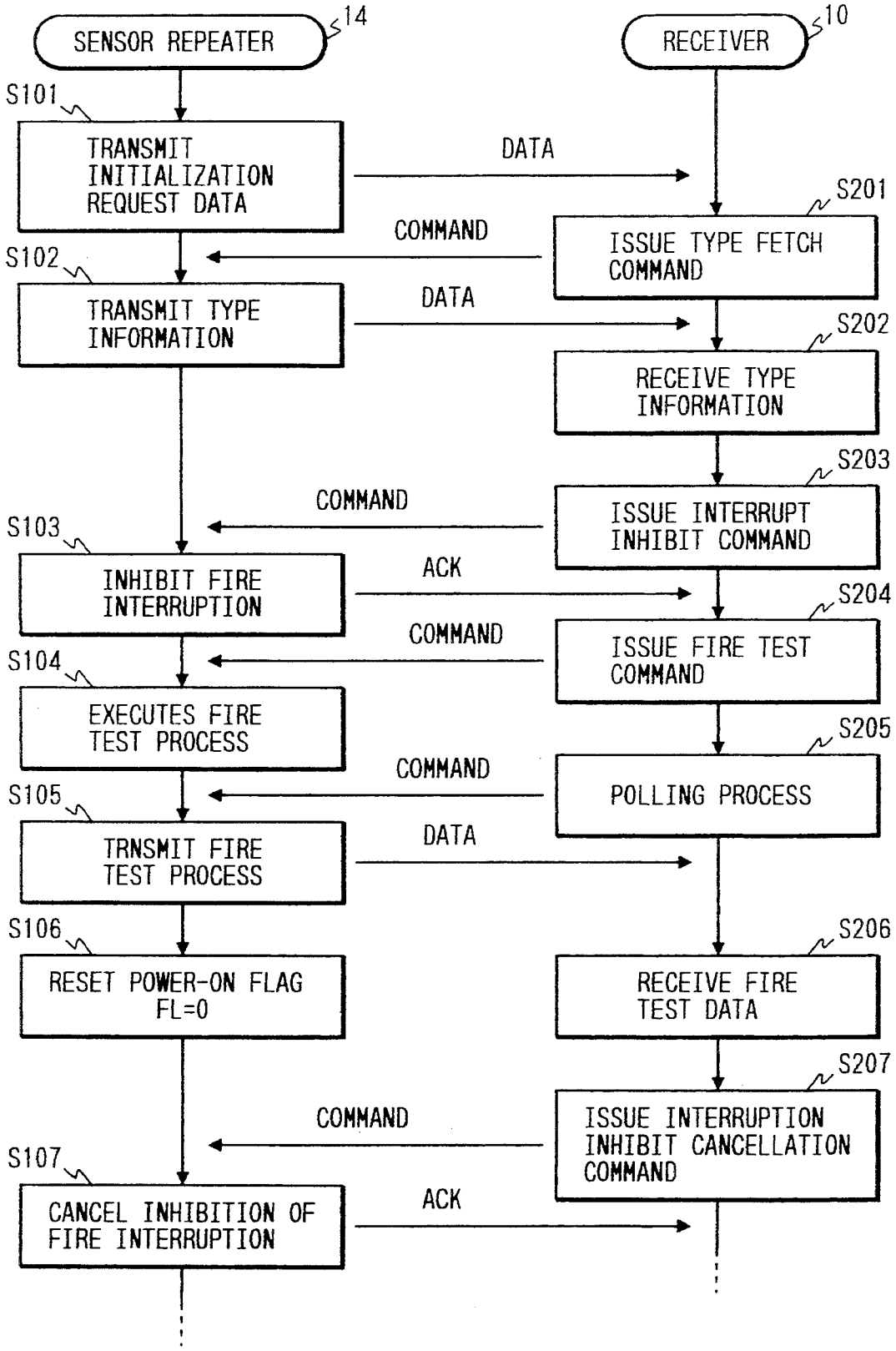
FIG. 12 is a flowchart showing the process conducted between the receiver and the sensor repeater.

FIG. 12 is a flowchart showing the initialization set and reply processes conducted between the receiver 10 and the sensor repeater 14 to which the on-off sensors are connected. In FIG. 12, the sensor repeater 14 transmits in step S101 the initialization request data as a reply to the polling from the receiver 10. The receiver 10 which receives the initialization request data issues a type fetch command in step S201. In response to this, the sensor repeater 14 transmits the type information in step S102.

The receiver 10 which receives the type information in step S202 recognizes the terminal as the sensor repeater 14 from the type information, and then conducts a reception process in which the relationship between the terminal address and the type of the sensor is registered in a memory table for managing the terminals. Then, the receiver 10 issues in step S203 the interrupt inhibit command for inhibiting the interruption reply from being conducted during the fire test period of the sensor repeater 14. The sensor repeater 14 sets in step S103 the inhibition of the fire interruption.

When the receiver 10 receives the acknowledgment of the fire interruption inhibition from the sensor repeater 14, the receiver issues the fire test command in step S204. In response to the fire test command, the sensor repeater 14 executes the fire test processes in step S104, and stores data obtained in the fire test, in the memory.

On the other hand, in step S205, the receiver 10 returns to the usual polling process. When the address coincidence in the polling from the receiver 10 is judged, the sensor repeater 14 transmits in step S105 the fire test data stored in the memory, to the receiver 10. Since a series of initialization reply processes is completed, the power-on flag FL is reset to 0 in step S106.

The receiver 10 which receives the fire test data from the sensor repeater 14 conducts in step S206 the reception process for the fire test data. In the reception process, when the fire test data fail to indicate the sensor signaling, a sensor abnormal state is output and displayed. After the reception process for the fire test data, the receiver 10 issues the interruption inhibit cancellation command in step S207. In response to the command, the sensor repeater 14 cancels in step S107 the inhibition state of the fire interruption, and returns to the usual state.

Figure 13:
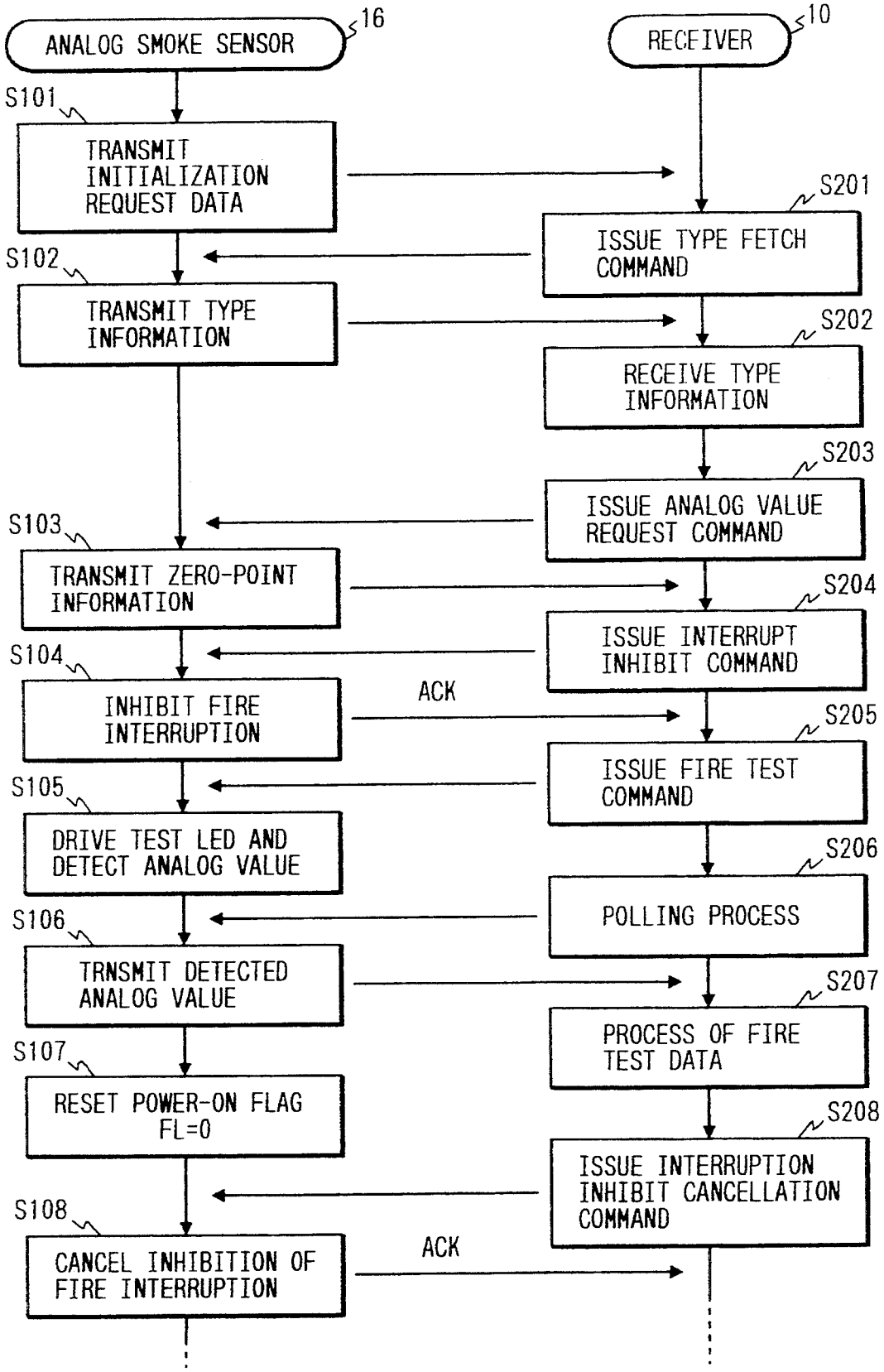
FIG. 13 is a flowchart showing the process conducted between the receiver and an analog sensor.

FIG. 13 is a flowchart showing the initialization set and reply processes conducted between the receiver 10 and the analog smoke sensor 16. In FIG. 13, the analog smoke sensor 16 transmits in step S101 the initialization request data, and then the receiver 10 issues the type fetch command in step S201. In response to the type fetch command, the analog smoke sensor 16 transmits the type information in step S102. The receiver 10 which receives the type information in step S202 recognizes the terminal as the analog smoke sensor 16, from the type information, and registers the relationship between the address and the analog smoke sensor 16, in the terminal managing memory.

Then, the receiver 10 issues in step S203 the analog value request command. In response to this, the analog smoke sensor 16 transmits zero-point information in step S103. When a smoke sensor of the scattered light type is used as the analog smoke sensor 16, for example, there is no smoke ingress during the usual monitor state, and therefore data representing the amount of light received at this time is transmitted as zero-point information.

Then, the receiver 10 issues in step S204 the interrupt inhibit command for inhibiting the fire interruption due to the sensor test. In response to this, the analog smoke sensor 16 sets in step S104 the inhibition of the fire interruption. Thereafter, the receiver 10 issues the fire test command in step S205. In response to the fire test command, the analog smoke sensor 16 drives in step S105 the test LED to emit light, detects an analog value, and stores the detected value in the memory.

At this time, the receiver 10 returns to the polling process of step S206. When the address coincidence in the polling from the receiver 10 is judged, the analog smoke sensor 16 transmits in step S106 the analog value which was obtained in the test operation and stored in the memory, to the receiver 10. Using the two sets of information, zero-point information obtained from the analog smoke sensor 16, and the analog value detected in the test, the receiver 10 conducts in step S207 the process of the fire test data.

Figure 14:
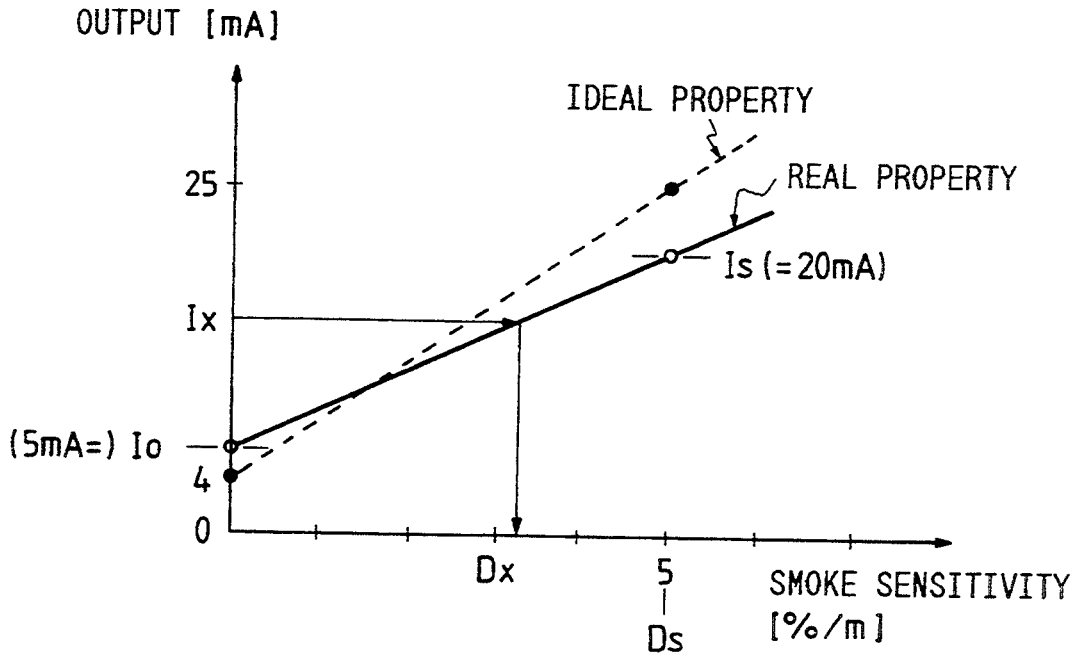
FIG. 14 is a flowchart showing the process conducted between the receiver and an analog sensor having an on-off fire detection function.

FIG. 14 shows the process of the fire test data. The zero-point information is the current $I_0$ measured at zero smoke density. The test operation current $I_s$ is the current responsive to illumination of the test lamp which is set to correspond to a smoke density of $D_g=5$ (%/m). We will assume, for purposes of explanation, that, in the initialization process, $I_0$ is measured at 5 mA and $I_s$ is measured at 20 mA. When zero-point information from the analog smoke sensor 16 indicates $I_0=5$ mA and the test analog value according to the test operation indicates $I_s=20$ mA, the actual property of the output current with respect to the smoke density is obtained as shown by a solid line.

On the other hand, as shown by a broken line, the ideal property which the analog smoke sensor 16 originally has is 4 to 25 mA with respect to the smoke density of 0 to 5 (%/m). Thus, the real characteristic of the sensor is very different from the ideal. An expression for obtaining the actual smoke density based on the detected output current is generated in the receiver 10.

Specifically, the slope K of the real property is obtained by $$K=D_s/(I_s-I_0)$$

In the illustrated case, K is obtained as 0.33. When the slope K of the real property is obtained in this way, the smoke density $D_x$ corresponding to the output current $I_x$ can be found by the following calculation $$D_x=KI_x$$

The method of setting the detection property on the basis of measured data of a sensor is described in detail in Unexamined Japanese Patent Publication No. SHO 61-247918.

Referring again to FIG. 13, the receiver 10, which has completed in step S207 the process of the fire test data, issues the interruption inhibit cancellation command in step S207. Since the initialization reply processes is completed, the power-on flag FL is reset to 0 in step S107. The analog smoke sensor 16 receives in step S108 the interruption inhibit cancellation command and cancels the inhibition of the fire interruption, and returns to the usual state.

Figure 15:
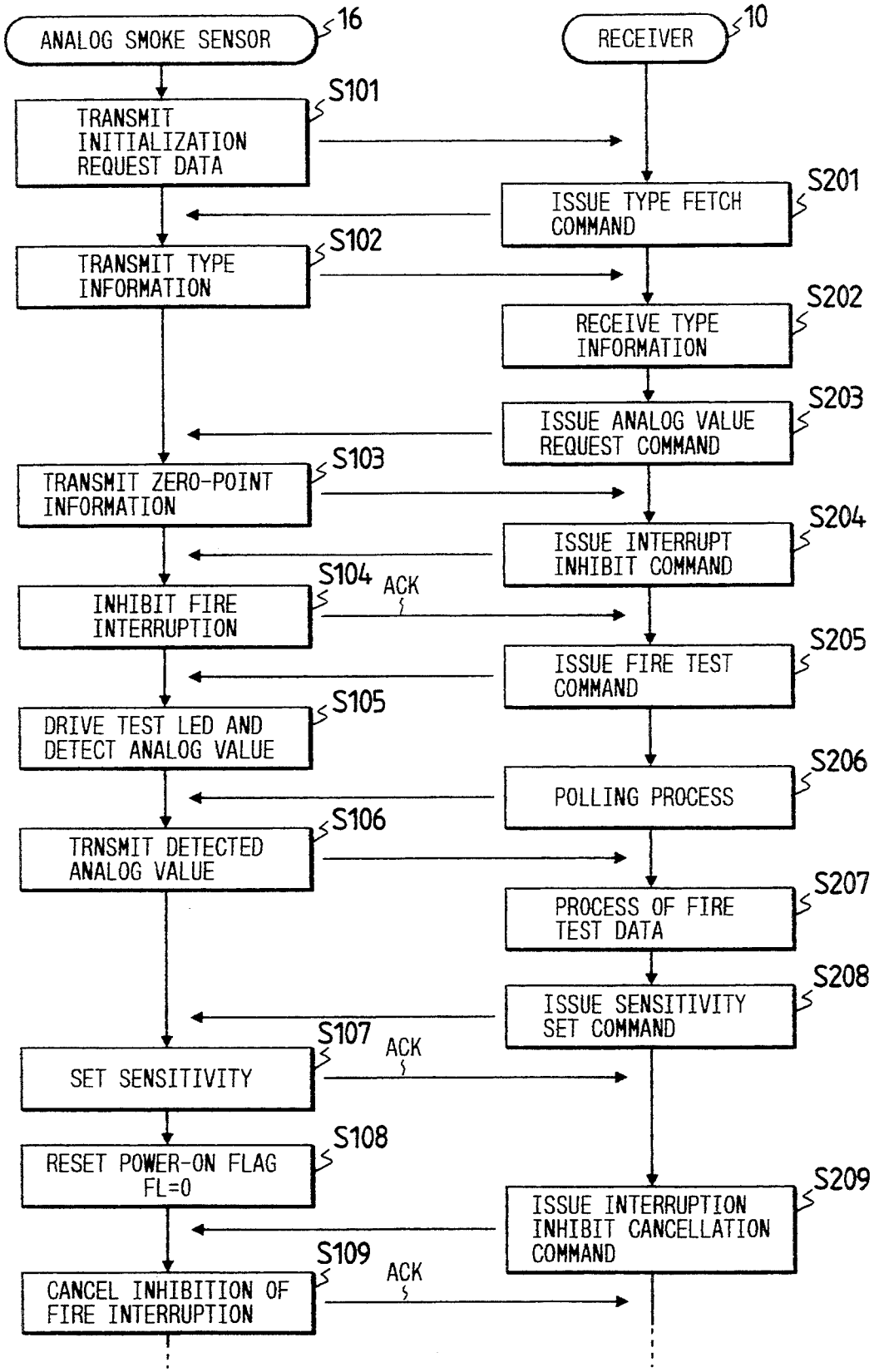
FIG. 15 is a flowchart showing the process conducted between the receiver and the control repeater.

FIG. 15 is a flowchart showing the process conducted in the case where the analog smoke sensor 16 is further provided with the fire detection function as an on-off sensor. In the analog smoke sensor 16, the function in which a fire detection signal is output as a result of a comparison with a threshold in the same manner as an on-off smoke sensor may be provided in addition to the usual analog fire detection function. The threshold for the fire judgment is set in accordance with the environment around the sensor.

In FIG. 15, which is the same as FIG. 13 through step S207, after the process of the fire test data in step S207, the receiver 10 obtains the threshold which corresponds to the set class, i.e., class 1, class 2, or class 3, and transmits the obtained threshold in the form of a data in the data field of the sensitivity set command. The analog smoke sensor 16 conducts the operation of setting the threshold indicative of the set sensitivity which has been transmitted from the receiver 10. The other processes are the same as those of FIG. 13.

FIGS. 13 and 15 show the operation of the analog smoke sensor 16. The analog heat sensor 18 used in the embodiment of FIG. 8 operates fundamentally in the same manner as the smoke sensor except that the collection of zero-point information in accordance with the analog value request command is not conducted and the test operation and the process of fire test data are conducted in a different manner.

In the embodiment of the analog heat sensor 18 shown in FIG. 8, when the sensor receives the fire test command, the constant-current circuit 120 and the fire test circuit 124 are driven so that a low-impedance state for producing the test temperature of 100° C. is temporarily generated. The detection voltage indicative of the test temperature of 100° C. is fetched by the transmission control circuit 130, and then transmitted as a test analog value to the receiver 10. In the receiver 10, the output of the constant-current circuit 120 is set to a fixed value $I_{const}$, and the following relational expression is established between the output current $I_{const}$ and the impedance Z of the heat detecting element 122:

$$V=I_{const}\times Z$$

and the following relation is set between the detection voltage V and the temperature T:

$$T=K\times V$$

When the detection voltage $V_{100}$ at the test temperature 100° C. is once obtained, accordingly, the value of the coefficient K corresponding to the real property can be obtained. Using the obtained coefficient K, thereafter, the temperature T can be obtained from the detection voltage V.

Figure 16:
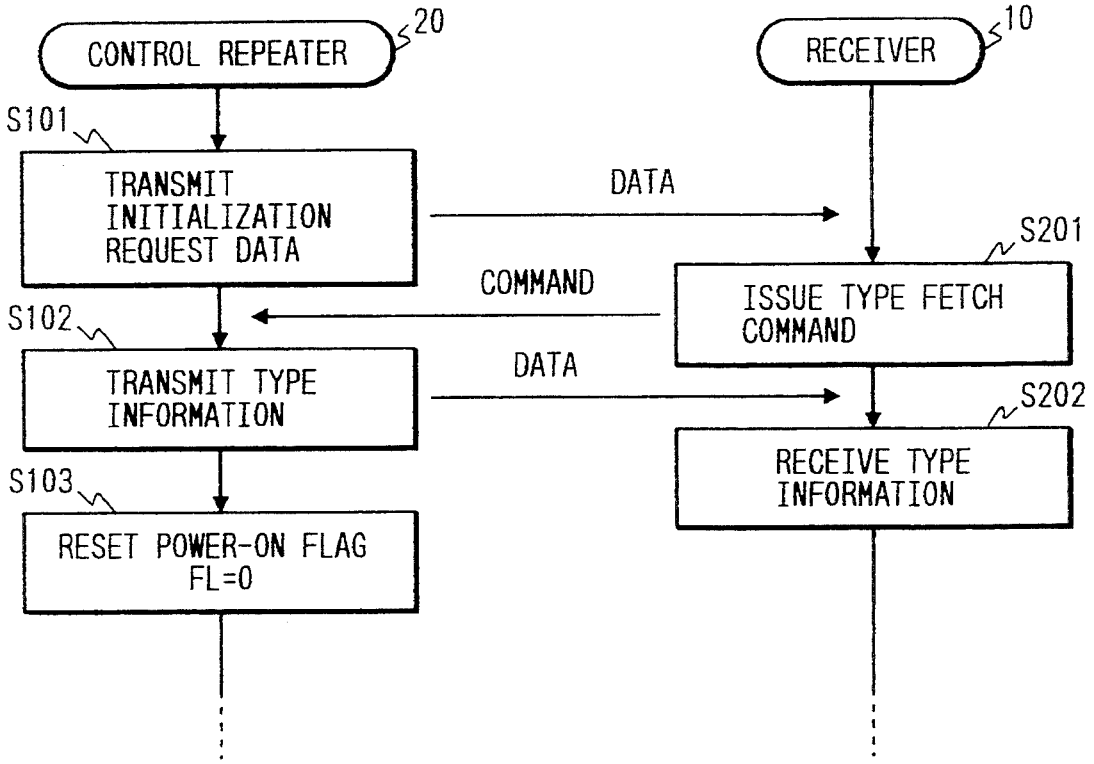
FIG. 16 is a flowchart showing in detail the initialization set process of terminal information conducted in the receiver of FIG. 10.

FIG. 16 is a flowchart showing the initialization set and reply processes conducted between the receiver 10 and the control repeater 20. In FIG. 16, the control repeater 20 transmits in step S101 the initialization request data, and then the receiver 10 issues the type fetch command in step S201. In response to this, the control repeater 20 transmits the type information in step S102. The receiver 10 conducts the reception process in which the relationship between the type information and the address is registered in the terminal managing memory.

After the transmittance of the type information of step S202 is completed, the control repeater 20 assumes that a series of initialization reply processes is completed, and resets the power-on flag FL to 0 in step S103. In this way, the process which should be conducted by the control repeater 20 is a simple one wherein only the type information is transmitted.

Figure 17:
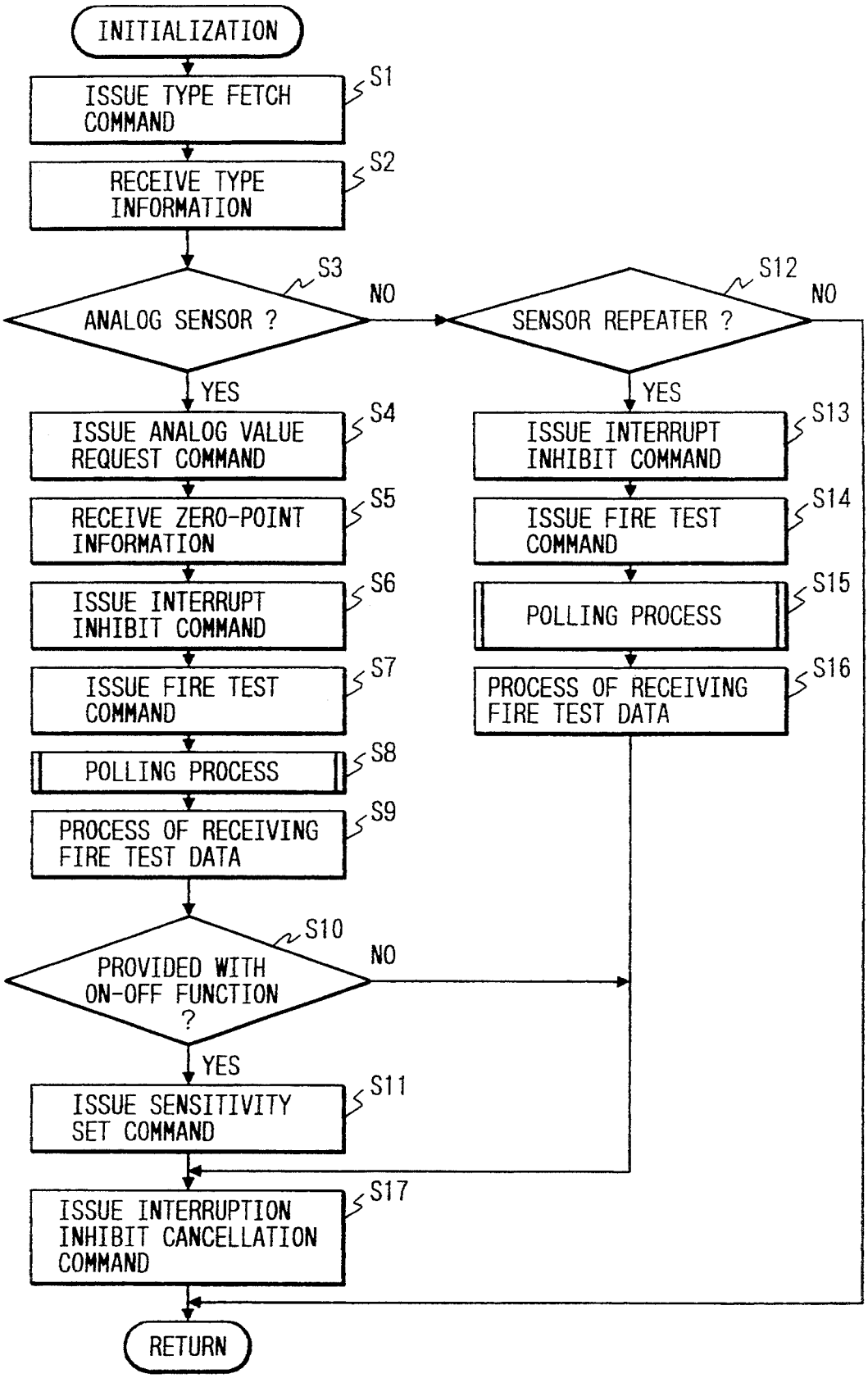
FIG. 17 is a flowchart showing the operation of executing the initialization set process in the receiver which corresponds to type information.

FIG. 17 is a flowchart showing in detail the operation of executing the initialization set process in response to the type information obtained in the receiver 10. That is, FIG. 17 shows the initialization set process of step S11 in FIG. 10 in the form of a subroutine. In the initialization set process shown in FIG. 17, the receiver 10 issues the type fetch command in step S1, and conducts the process of receiving the type information data from a terminal in step S2. In step S3, the receiver 10 judges whether or not the terminal is an analog sensor. If not, in step S12, it is judged whether or not the terminal is a sensor repeater to which an on-off sensor is connected.

If the terminal is an analog smoke sensor or an analog heat sensor, the processes of steps S4 to S11 are conducted. If the terminal is a sensor repeater to which an on-off sensor is connected, the processes of steps S13 to S16 are conducted. In the case where the terminal is a control repeater, no further process is conducted. If the analog sensor also includes an on-off sensor, the process of issuing the sensitivity set command of the steps S10 and S11 is additionally conducted.

In the embodiment described above, only the receiver 10 is disposed as the receiving unit. In the case of a very large installation, the monitor may have a configuration wherein repeater panels disposed on each floor, function as local receivers, and are connected to a main receiver disposed in a central monitor system through transmission lines, with the terminals being connected to each of the repeater panels through the transmission line 12 as shown in the receiver 10 of FIG. 1. In such a large scale system, therefore, the receiving unit includes a receiver and repeater panels which function as local receivers.

In an installation wherein a main receiver for administrating local receivers is not provided and local receivers are distributed on each floor so as to respectively function as a receiver, the receiving unit in the invention may be configured by only the local receivers.

As described above, according to the invention, even when a terminal such as a repeater or an analog sensor is replaced with another one between polling calls to the terminal, the receiver recognizes the replacement and properly conducts an initialization process, which is required for the replacement terminal, thereby enabling the disaster prevention monitor to properly monitor the new terminal.

Furthermore, the monitor of the invention automatically conducts a test operation on the new terminal to confirm whether or not the new terminal properly functions, whereby the reliability of the disaster prevention monitor can be greatly improved.

What is claimed is:

1. A disaster prevention monitor comprising:

a plurality of terminals for detecting disaster-related conditions, and a receiver for polling said terminals to obtain various types of information therefrom and commanding said terminals to perform various commanded operations and for receiving and processing information relating to said terminals;

power-on detecting means at each said terminal for detecting a power-on condition when the power is first connected to a terminal;

reply means at each said terminal responsive to a polling signal directed thereto from said receiver for transmitting to said receiver data representing said power-on condition; and initialization means for performing an initialization sequence to obtain and store at said receiver new initialization information about the said terminal which has transmitted the data representing said power-on condition.

2. A disaster prevention monitor as claimed in claim 1, wherein said power-on detecting means operates to set flag information at said terminal when a power-on condition occurs, and wherein said reply means operates to transmit to said receiver an information fetch request signal which requests said receiver to fetch information necessary for the receiver to obtain and store initialization information for said terminal.

3. A disaster prevention monitor as claimed in claim 2, wherein said initialization means comprises:

means at said receiver responsive to an information fetch request signal from a terminal for transmitting to said terminal an information request con, and signal; and means at each said terminal responsive to an information request command signal for transmitting to said receiver type information identifying the nature of the terminal.

4. A disaster prevention monitor as claimed in claim 3, wherein at least one said terminal is a sensor repeater having an on-off fire sensor connected thereto and being responsive to a fire test con, and signal for conducting a fire test on itself and generating fire test result data.

5. A disaster prevention monitor as claimed in claim 4, wherein said initialization means further comprises:

means at said receiver responsive to receipt of type information indicating that the terminal is said sensor repeater, for transmitting to said sensor repeater terminal a fire test command; and means at said sensor repeater terminal for transmitting to said receiver said fire test result data in response to receipt of said fire test command signal.

6. A disaster prevention monitor as claimed in claim 3, wherein at least one said terminal is an analog fire sensor, and wherein said initialization means further comprises:

means at said receiver responsive to receipt of type information indicating that the terminal is said analog fire sensor for transmitting to said analog fire sensor terminal an analog value request command signal and a fire test command signal;

means at said analog fire sensor terminal responsive to an analog value request command signal to detect and transmit to said receiver zero-point information about said sensor;

means at said analog fire sensor terminal responsive to a fire test command signal for conducting a fire test and obtaining and transmitting to said receiver test result information; and means at said receiver responsive to receipt of said zero-point information and said test result information for generating and storing initialization information about said analog fire sensor terminal.

7. A disaster prevention monitor as claimed in claim 6, wherein said analog fire sensor terminal includes an on-off sensor which compares a detected analog value with a threshold corresponding to a predetermined detection sensitivity to generate a fire detection signal, and wherein said means for conducting a fire test further generates and transmits to said receiver said fire detection signal; and said means at said receiver for generating and storing is further responsive to said fire detection signal.

8. A disaster prevention monitor according to claim 5, wherein said initialization means further comprises means for transmitting, prior to the transmission of said fire test command signal, an interrupt inhibit command for inhibiting an interruption reply transmission of said fire test result data from said sensor repeater, wherein said fire test result data obtained in a terminal test is transmitted to said receiver as a reply signal in response to a cyclic polling call signal which designates a terminal address corresponding to that of said sensor repeater and which call signal is sequentially transmitted from said receiver.

9. A disaster prevention monitor according to claim 6, wherein said initialization means further comprises means for transmitting, prior to the transmission of said fire test command signal, an interrupt inhibit command for inhibiting an interruption reply transmission of said fire test result data from said analog fire sensor, wherein said fire test result data obtained in a terminal test is transmitted to said receiver as a reply signal in response to a cyclic polling call signal which designates a terminal address corresponding to that of said analog fire sensor and which call signal is sequentially transmitted from said receiving means.

10. A disaster prevention monitor according to claim 7, wherein said initialization means further comprises means for transmitting, prior to the transmission of said fire test command signal, an interrupt inhibit command for inhibiting an interruption reply transmission of said fire test result data from said analog fire sensor, wherein said fire test result data obtained in a terminal test is transmitted to said receiver as a reply signal in response to a cyclic polling call signal which designates a terminal address corresponding to that of said analog fire sensor and which call signal is sequentially transmitted from said receiving means.

11. A disaster prevention monitor according to claim 3, wherein at least one said terminal is a control repeater to which a control load is connected, and wherein said type information indicating that said terminal is said control repeater is set in said receiver as initialization information without further transmission of any test commands to said control repeater.

12. In a disaster prevention monitor system having a plurality of terminals for detecting disaster-related conditions, and a receiver for polling said terminals to obtain various information therefrom and commanding said terminals to perform various commanded operations and for maintaining initialization information of data from said terminals pertaining to said disaster-related conditions, the method comprising the steps of:

detecting a power-on condition of a terminal and thereby setting flag information to indicate power-on connection to a terminal;

responsive to the setting of said flag information, fetching information from said terminal that is necessary for obtaining correct initializing information pertaining to said terminal; and obtaining and storing at said receiver correct initializing information from said information fetched from said terminal, whereby the power-on of a terminal results in the correction of initialization information at said receiver.

13. A disaster prevention method according to claim 12, wherein the step of fetching information comprises fetching type information indicating the nature of said terminal.

14. A disaster prevention method according to claim 13, wherein the step of fetching information further comprises conducting a test operation on an on-off fire sensor terminal to obtain test results therefrom, when said type information indicates that the terminal is a sensor repeater to which an on-off fire sensor is connected through a signal line.

15. A disaster prevention method according to claim 13, wherein, when said type information indicates the terminal to be an analog fire sensor, the method further comprises:

collecting zero-point information from said analog sensor and conducting a test operation on said analog fire sensor to collect test analog values indicating predetermined detected physical values obtained as a result of the terminal test; and based on the zero-point information and the test analog values, generating information required for correction of analog values obtained at said analog fire sensor during usual operation.

16. A disaster prevention method according to claim 13, wherein, when the type information indicates the terminal is an analog fire sensor having an on-off fire sensor which compares a detected analog value with a threshold corresponding to a predetermined detection sensitivity to transmit a fire detection signal, the method further comprises:

collecting zero-point information from said analog fire sensor and conducting a test operation on said analog fire sensor to collect test analog values indicating predetermined detected physical values obtained as a result of said test operation;

based on the zero-point information and the test analog values, generating information required for correction of analog values obtained at said analog fire sensor during usual operation; and setting a sensitivity of the terminal according to threshold information for giving a detection sensitivity which is corrected on the basis of the correction information.

17. A disaster prevention method according to claim 14, further comprising the steps of:

inhibiting an interruption reply transmission of a fire signal before the test operation; and obtaining information of the result of the test operation as a reply signal in response to a cyclic call signal which designates a terminal address.

18. A disaster prevention method according to claim 15, further comprising the steps of:

inhibiting an interruption reply transmission of a fire signal before the test operation; and obtaining information of the result of the test operation as a reply signal in response to a cyclic call signal which designates a terminal address.

19. A disaster prevention method according to claim 16, further comprising the steps of:

inhibiting an interruption reply transmission of a fire signal before the test operation; and obtaining information of the result of the test operation as a reply signal in response to a cyclic call signal which designates said terminal address.

20. A disaster prevention method according to claim 12, wherein, when the type information indicates the terminals is a control repeater to which a control load is connected through a signal line, the method further comprises;

fetching the type information of said terminal; and conducting a process of setting the type information.

* * * * *